US007721646B2

(12) United States Patent
Herbert et al.

(10) Patent No.: US 7,721,646 B2
(45) Date of Patent: May 25, 2010

(54) OFFSET PRINTING GROUPS OF A PRINTING PRESS FOR NEWSPAPER PRINTING AND A WEB-FED ROTARY PRINTING PRESS

(75) Inventors: Burkard Otto Herbert, Würzburg (DE); Lothar Franz Hohmann, Erlabrunn (DE); Bernd Kurt Masuch, Kürnach (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 406 days.

(21) Appl. No.: 11/579,702

(22) PCT Filed: Apr. 29, 2005

(86) PCT No.: PCT/EP2005/051961

§ 371 (c)(1),
(2), (4) Date: Nov. 6, 2006

(87) PCT Pub. No.: WO2005/108078

PCT Pub. Date: Nov. 17, 2005

(65) Prior Publication Data

US 2007/0181019 A1 Aug. 9, 2007

Related U.S. Application Data

(60) Provisional application No. 60/631,421, filed on Nov. 30, 2004.

(30) Foreign Application Priority Data

May 4, 2004 (DE) ..... 10 2004 022 231
Jun. 23, 2004 (DE) ..... 10 2004 030 062
Jul. 14, 2004 (DE) ..... 10 2004 033 912

(51) Int. Cl.
*B41F 7/02* (2006.01)
*B41F 5/04* (2006.01)

(52) U.S. Cl. ..... 101/217; 101/219

(58) Field of Classification Search ..... 101/216, 101/217, 220, 227
See application file for complete search history.

(56) References Cited

U.S. PATENT DOCUMENTS 3,983,811 A 10/1976 Fuchs et al.

(Continued)

FOREIGN PATENT DOCUMENTS

DE 25 28 008 6/1975

(Continued)

OTHER PUBLICATIONS

Bolza-Schunemann, Hans B., "Six-wide Newspaper Presses—History and Facts," Newspaper Techniques, Sep. 1991, p. 130-136.

(Continued)

*Primary Examiner*—Daniel J Colilla
*Assistant Examiner*—David Banh
(74) *Attorney, Agent, or Firm*—Jones, Tullar & Cooper, P.C.

(57) ABSTRACT

An offset printing group is part of a printing machine which is used for printing newspapers. The offset printing group includes a printing cylinder and a transfer cylinder. The length of the transfer cylinder corresponds to at least six widths of newspaper pages. Two blankets are arranged adjacent each other on the peripheral surface of the transfer cylinder. A width of each of these blankets in the axial direction of the transfer cylinder corresponds to three widths of newspaper pages.

23 Claims, 30 Drawing Sheets

U.S. PATENT DOCUMENTS

| | | | | |
|---|---|---|---|---|
| 4,671,501 | A | 6/1987 | Fujishiro | |
| 5,303,909 | A | 4/1994 | Maylaender | |
| 5,328,437 | A | 7/1994 | Maylander | |
| 5,845,574 | A | 12/1998 | Dilling et al. | |
| 6,024,684 | A | 2/2000 | Maylander | |
| 6,152,034 | A | 11/2000 | Dufour | |
| 6,298,781 | B1 | 10/2001 | Dufour | |
| 6,408,747 | B2 | 6/2002 | Koppelkamm et al. | |
| 6,422,552 | B1 | 7/2002 | Chesno et al. | |
| 6,712,749 | B1 | 3/2004 | Michalik et al. | |
| 6,920,824 | B2 | 7/2005 | Holm | |
| 7,066,090 | B2 | 6/2006 | Holm | |
| 2002/0184986 | A1 | 12/2002 | Oehmen et al. | |
| 2002/0189470 | A1* | 12/2002 | Holm | 101/375 |
| 2003/0097946 | A1* | 5/2003 | Kawabata et al. | 101/415.1 |
| 2003/0101886 | A1* | 6/2003 | Rauh | 101/415.1 |
| 2004/0231535 | A1* | 11/2004 | Gerner et al. | 101/217 |
| 2004/0244615 | A1 | 12/2004 | Herbert et al. | |
| 2005/0145129 | A1 | 7/2005 | Holm | |
| 2005/0145130 | A1 | 7/2005 | Holm | |
| 2006/0117974 | A1 | 6/2006 | Holm | |

FOREIGN PATENT DOCUMENTS

| | | | |
|---|---|---|---|
| DE | 24 22 696 | | 11/1975 |
| DE | 41 28 797 | | 8/1991 |
| DE | 42 04 254 | | 2/1992 |
| DE | 196 28 647 | | 7/1996 |
| DE | 196 28 935 | | 7/1996 |
| DE | 198 03 809 | | 1/1998 |
| DE | 100 03 025 | | 1/2000 |
| DE | 100 16 409 | | 4/2000 |
| DE | 200 23 363 | | 12/2000 |
| DE | 200 23 364 | | 12/2000 |
| EP | 1 072 551 | | 7/2000 |
| EP | 1 238 935 | | 2/2002 |
| GB | 1 476 707 | | 6/1977 |
| WO | WO 97/17200 | | 5/1997 |
| WO | WO 01/39974 | A2 | 6/2001 |
| WO | WO 01/39974 | A3 | 6/2001 |
| WO | WO/03016058 | * | 2/2003 |
| WO | WO 03/031180 | | 4/2003 |

OTHER PUBLICATIONS

KBA Journal, a "Little Sister" for the Commander and Express, Newspaper Techniques, Oct. 1991, p. 48-51.

* cited by examiner a)
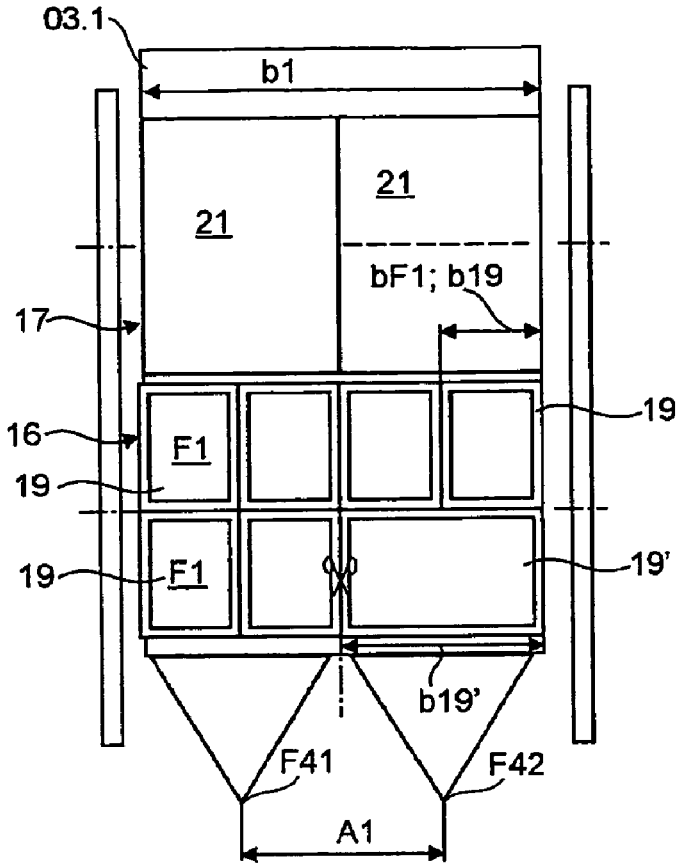
b)
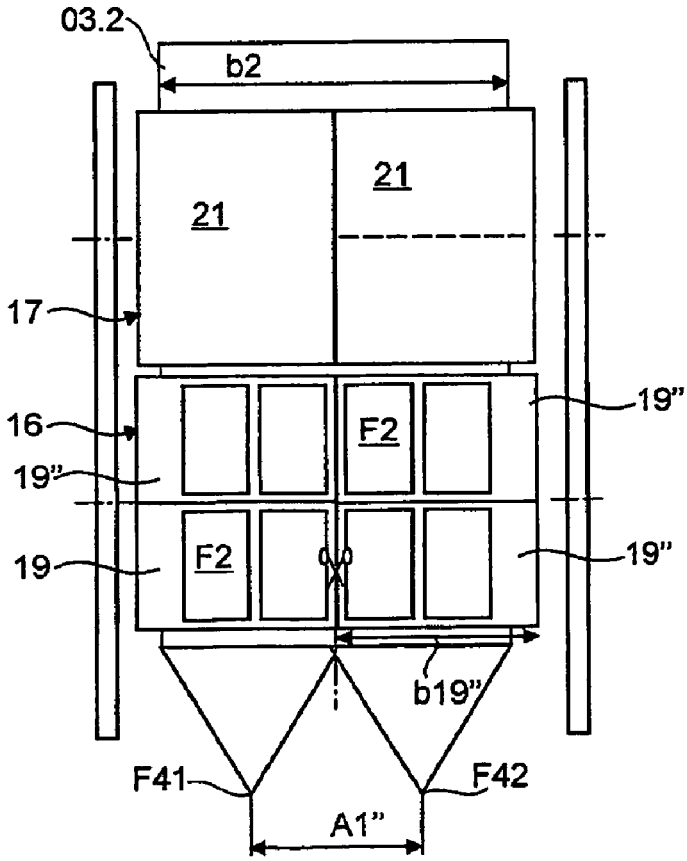
Fig. 33

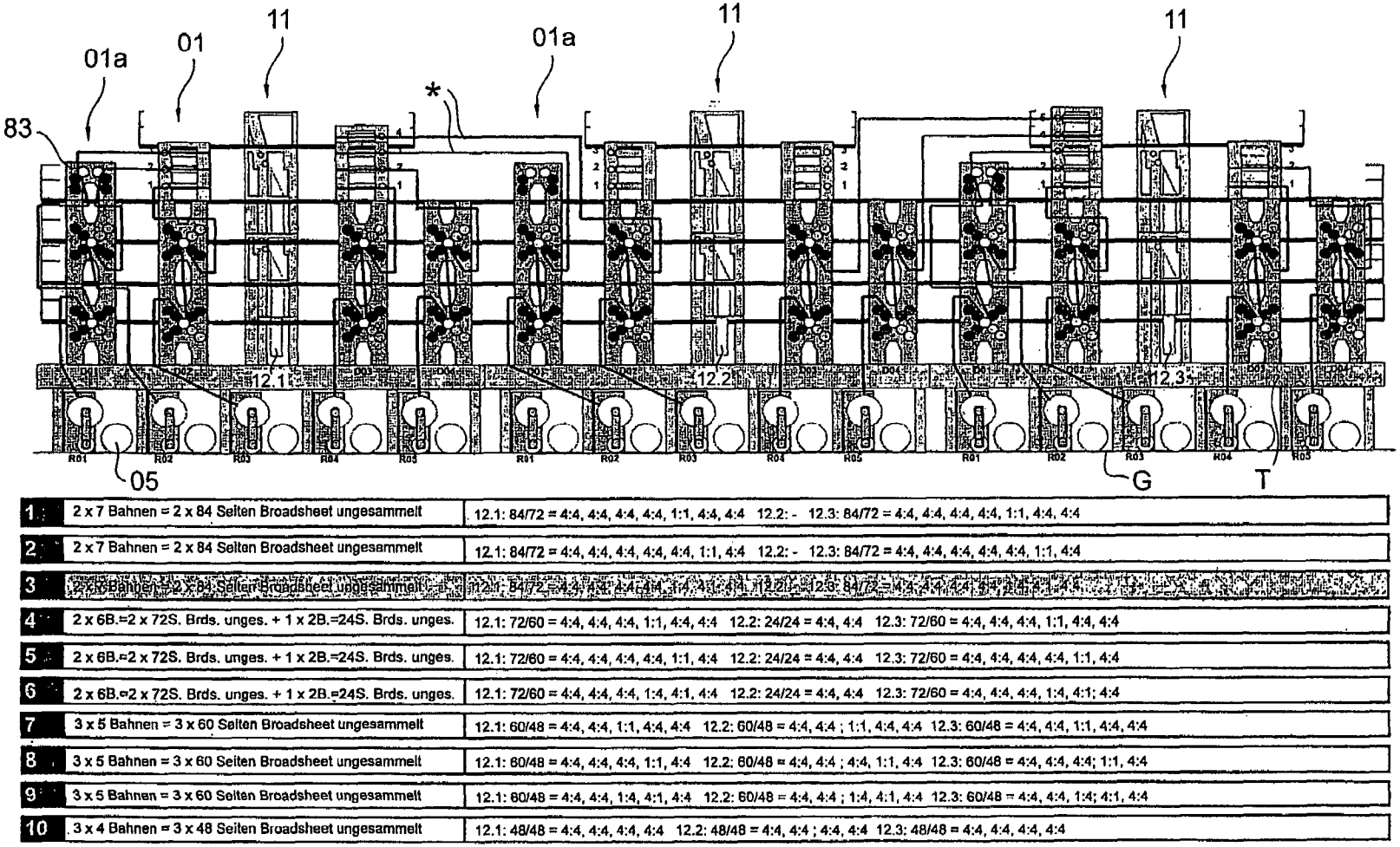

| | | | |
|---|---|---|---|
| 1 | 2 x 7 Bahnen = 2 x 84 Seiten Broadsheet ungesammelt | 12.1: 84/72 = 4:4, 4:4, 4:4, 4:4, 1:1, 4:4, 4:4 | 12.2: - 12.3: 84/72 = 4:4, 4:4, 4:4, 4:4, 1:1, 4:4, 4:4 |
| 2 | 2 x 7 Bahnen = 2 x 84 Seiten Broadsheet ungesammelt | 12.1: 84/72 = 4:4, 4:4, 4:4, 4:4, 4:4, 1:1, 4:4 | 12.2: - 12.3: 84/72 = 4:4, 4:4, 4:4, 4:4, 4:4, 1:1, 4:4 |
| 3 | [illegible] | [illegible] | [illegible] |
| 4 | 2 x 6B.=2 x 72S. Brds. unges. + 1 x 2B.=24S. Brds. unges. | 12.1: 72/60 = 4:4, 4:4, 4:4, 1:1, 4:4, 4:4 | 12.2: 24/24 = 4:4, 4:4 12.3: 72/60 = 4:4, 4:4, 4:4, 1:1, 4:4, 4:4 |
| 5 | 2 x 6B.=2 x 72S. Brds. unges. + 1 x 2B.=24S. Brds. unges. | 12.1: 72/60 = 4:4, 4:4, 4:4, 4:4, 1:1, 4:4 | 12.2: 24/24 = 4:4, 4:4 12.3: 72/60 = 4:4, 4:4, 4:4, 4:4, 1:1, 4:4 |
| 6 | 2 x 6B.=2 x 72S. Brds. unges. + 1 x 2B.=24S. Brds. unges. | 12.1: 72/60 = 4:4, 4:4, 4:4, 1:4, 4:1, 4:4 | 12.2: 24/24 = 4:4, 4:4 12.3: 72/60 = 4:4, 4:4, 4:4, 1:4, 4:1; 4:4 |
| 7 | 3 x 5 Bahnen = 3 x 60 Seiten Broadsheet ungesammelt | 12.1: 60/48 = 4:4, 4:4, 1:1, 4:4, 4:4 | 12.2: 60/48 = 4:4, 4:4 ; 1:1, 4:4, 4:4 12.3: 60/48 = 4:4, 4:4, 1:1, 4:4, 4:4 |
| 8 | 3 x 5 Bahnen = 3 x 60 Seiten Broadsheet ungesammelt | 12.1: 60/48 = 4:4, 4:4, 4:4, 1:1, 4:4 | 12.2: 60/48 = 4:4, 4:4 ; 4:4, 1:1, 4:4 12.3: 60/48 = 4:4, 4:4, 4:4; 1:1, 4:4 |
| 9 | 3 x 5 Bahnen = 3 x 60 Seiten Broadsheet ungesammelt | 12.1: 60/48 = 4:4, 4:4, 1:4, 4:1, 4:4 | 12.2: 60/48 = 4:4, 4:4 ; 1:4, 4:1, 4:4 12.3: 60/48 = 4:4, 4:4, 1:4; 4:1, 4:4 |
| 10 | 3 x 4 Bahnen = 3 x 48 Seiten Broadsheet ungesammelt | 12.1: 48/48 = 4:4, 4:4, 4:4, 4:4 | 12.2: 48/48 = 4:4, 4:4 ; 4:4, 4:4 12.3: 48/48 = 4:4, 4:4, 4:4, 4:4 |

Fig. 34

OFFSET PRINTING GROUPS OF A PRINTING PRESS FOR NEWSPAPER PRINTING AND A WEB-FED ROTARY PRINTING PRESS

CROSS-REFERENCE TO RELATED APPLICATIONS

This application is the U.S. national phase, under 35 USC 371, of PCT/EP2005/051961, filed Apr. 29, 2005; published as WO 2005/108078 A1 on Nov. 17, 2005, and claiming priority to DE 10 2004 022 231.2, filed May 4, 2004, to DE 10 2004 030 062.3, filed Jun. 23, 2004, to DE 10 2004 033 912.0, filed Jul. 14, 2004 and to U.S. 60/631,421, filed Nov. 30, 2004, the disclosures of which are expressly incorporated herein by reference.

FIELD OF THE INVENTION

The present invention is directed to offset printing group of a printing press for newspaper printing. The offset printing group has a forme cylinder and a transfer cylinder. The transfer cylinder has a length of at least six newspaper pages and has only two blankets on its outer surface.

BACKGROUND OF THE INVENTION

DE 25 28 008 A1 shows a printing press for use in a direct printing process, and having forme cylinders which can be equipped with six printing plates in the axial direction and with two printing plates in the circumferential direction, and also having counter-pressure cylinders, on which three printing blankets can be arranged in the axial direction and one printing blanket can be arranged in the circumferential direction. Both the printing plates, which are arranged side-by-side, as well as the printing blankets, which are also arranged side-by-side, are each offset, with respect to each other, in the circumferential direction.

DE 24 22 696 C2 shows a satellite printing unit of a width of six plates with offset printing groups, and having nine or ten cylinders. The two center ones of six printing formes, which are arranged side-by-side in the axial direction, are arranged offset, in the circumferential direction, with respect to the outer ones of the printing formes on the forme cylinder.

A triple-wide web-fed rotary printing press, with two formers arranged on two different levels placed on top of each other, is known from DE 41 28 797 A1.

A folding structure is known from U.S. Pat. No. 4,671,501. Two formers are arranged on top of each other, in which formers, following their passage through winding rollers, the webs are longitudinally cut upstream of a third former. The partial webs are turned by 90° by a third former and, after having been combined into two continuous webs, are subsequently fed to the two formers which are arranged on top of each other.

A folding structure with two groups of three formers each, which two groups of formers are vertically offset with respect to each other, is known from EP 1 072 551 A2.

A folding structure is known from WO 97/17 200 A2, in which cut partial webs, which are transversely offset with respect to each other, are fed to different formers. The formers, which are arranged horizontally side-by-side, are arranged partially offset with respect to each other.

A longitudinal cutting arrangement for variably cut widths is known from EP 1 238 395 A2. This cutting arrangement has upper cutters which are movable in the axial direction, and a lower cutter shaft with a number of grooves exceeding the number of the upper cutters.

DE 42 04 254 A1 discloses a folding structure of a printing press which is four newspaper pages wide. Two formers, which can be shifted transversely with respect to the web running direction, are arranged on a lower former level, and a single stationary former is arranged on a level above the lower former level. In one mode of operation, a newspaper with four pages is produced using the two lower formers. In another mode of operation six pages of a telephone directory are provided side-by-side by the three formers. In the latter case, the two lower formers are moved apart.

EP 1 072 551 A2 shows a former arrangement with two groups of three cylinders each. The formers of one group are located on one level and overlap each other, at least viewed in their horizontal direction, in the vertical extension.

It is known from DE 196 28 647 A1 to imprint a web with panorama printed pages, which panorama printed pages have printing extending over two adjacent newspaper pages, without interruption.

In connection with double-width printing groups, DE 100 16 409 A1 discloses a transfer cylinder having two printing blankets situated side-by-side. Triple-width cylinders are also mentioned, in addition to single-width and double-width cylinders.

WO 01/39974 A discloses a multitude of options for covering printing group cylinders of single and double width with dressings. The transfer cylinder always has dressings which, in an example of double wide cylinders, are either two newspaper pages wide, or extend over the entire length, i.e. in this case are four newspaper pages wide. In an expansion of the teaching of this pattern to even wider cylinders, and in particular to triple-wide cylinders, the arrangement of three or more side-by-side arranged cylinders takes place in an analogous manner in alignment or alternatingly.

A former structure is disclosed in DE 100 03 025 C1. Two formers are arranged to be movable transversely to the web running direction in order to make possible imprinting and processing of variable web widths.

DE 198 03 809 A1 discloses double-wide printing groups and teaches to configure the forme cylinder with a single circumference. In the case represented in connection with a printing group of a width of four newspaper pages, the transfer cylinder has two dressings which are offset by 180°, with respect to each other, in the circumferential direction. In one embodiment, a full web with eight side-by-side arranged book pages, and a web of partial web with six side-by-side arranged book pages, can be imprinted.

SUMMARY OF THE INVENTION

The object of the present invention is directed to providing offset printing group of a printing press for newspaper printing.

In accordance with the present invention, this object is attained by the provision of an offset printing group having a forme cylinder and a transfer cylinder. The transfer cylinder has an axial length of at least six standing newspaper pages. Two printing blankets are arranged side-by-side in the axial direction of the shell surface of the transfer cylinder. Each of these two blankets has a length in the axial direction of three standing newspaper pages.

The advantages to be achieved by the present invention consist, in particular, in making possible a cost-effective and a highly productive way of constructing a web-fed rotary printing press for use in the dependable production of different formats of production.

This objective is made possible, in particular, in connection with a six pages wide press, for example by the use of two side-by-side arranged, three page wide rubber blankets. The webs of different width, such as, for example, webs of material, are each conducted centered with respect to the transfer cylinder. The joint between the two printing blankets on the center double side comes to lie in the non-printed area in the area of the longitudinal fold.

It is of particular advantage if one or several devices of web guidance and/or web processing elements, which work together with the web, can be variably adjusted to the different web widths. These devices are, for example, pressure rollers in the draw-in units, catcher rollers of a catcher device, cutters of a longitudinal cutting device, pressure rollers of a traction group and/or side-by-side arranged formers of a folding structure. In an advantageous manner, the web is conducted through the press symmetrically with respect to the center axis of the printing press, such as, for example, centered with respect to the cylinder width. In case of the existence of an odd number of guidance and/or processing elements, in a preferred further development of the present invention, a center one of these guidance or processing elements is arranged in the above-mentioned plane of symmetry. This element can be arranged fixed in the transverse direction, with respect to the transport direction, while the outer guidance and/or processing elements should be configured to be movable transversely with respect to the transport direction and therefore adjustable to the web width.

In a triple-width embodiment of the printing press in accordance with the present invention, additional advantages exist in that, in comparison with a double-width printing press, the production dependability is considerably increased while achieving the same desired product amount. Also, while maintaining the number of printing units, it is also possible to increase the output of the printing press, or of each printing group, by 50%. It is possible to reduce the number of roll changers, thus reducing the investment, the frequency of roll changes, thereby improving production dependability, as well as the set-up time in the course of drawing in the webs, thereby reducing cycling times, in comparison with a double-wide printing press, for the same product amount.

In an advantageous embodiment of the present invention, the printing units are configured as nine-cylinder satellite printing units which configuration results, on the one hand, in great precision in the color register, and on the other hand, results in a vibration-free construction. The configuration as a satellite printing unit is also advantageous because, with the requirement for imprinting different web widths in the rubber-against-rubber printing group, there would be direct contact zones without a paper web in at least one web width. This would lead to greatly changed conveying behavior, which, to some extent, could result in considerable register deviations and creases.

Vibrations are also reduced by the advantageous arrangement, embodiment and fastening of dressings on the cylinders in accordance with the present invention. Openings on the shell faces, in the circumferential direction are, for one, minimized. Moreover, it is possible to arrange the openings, at least on the transfer cylinder, alternatingly offset, with respect to each other, in the circumferential direction. A closed shell face always works together, at least over a section length, with the forme or satellite cylinder.

A coverage with only two dressings, each of a width of three printed pages, which coverage is symmetrical to the width of the transfer cylinder, is particularly advantageous. In contrast to the printing blankets of a width of two printed pages, which was previously customary, with different web widths it is possible to perform printing operations without a previous change of printing blankets.

The driving of the satellite cylinder, or cylinders, independently of the cylinder pairs, has particularly great advantages in view of a possible variable operation. For example, it is possible to perform set-up operations, such as, for example, a flying printing forme change, or washing, during production. It is otherwise also possible to draw-in a web while other cylinders, or other pairs of cylinders, are stopped or pass through a set-up program. It is also of advantage, in the case of the presence of printing blankets with positively or negatively conveying properties, to operate the satellite cylinder at a surface speed which is different from the surface speeds of the remaining cylinders.

In an advantageous embodiment of the present invention, a superstructure of the printing press has at least one longitudinal cutting device with at least five cutters, which at least five cutters are spaced apart from each other transversely with respect to the running direction of the paper.

BRIEF DESCRIPTION OF THE DRAWINGS

Preferred embodiments of the present invention are represented in the drawings and will be described in greater detail in what follows.

Shown are in:

FIG. 1, a web-fed rotary printing press in a lateral view, in

FIG. 2, a schematic side view of a printing group, in

FIG. 3, a schematic top plan view of a printing group, in

DESCRIPTION OF THE PREFERRED EMBODIMENTS

Figure 1:
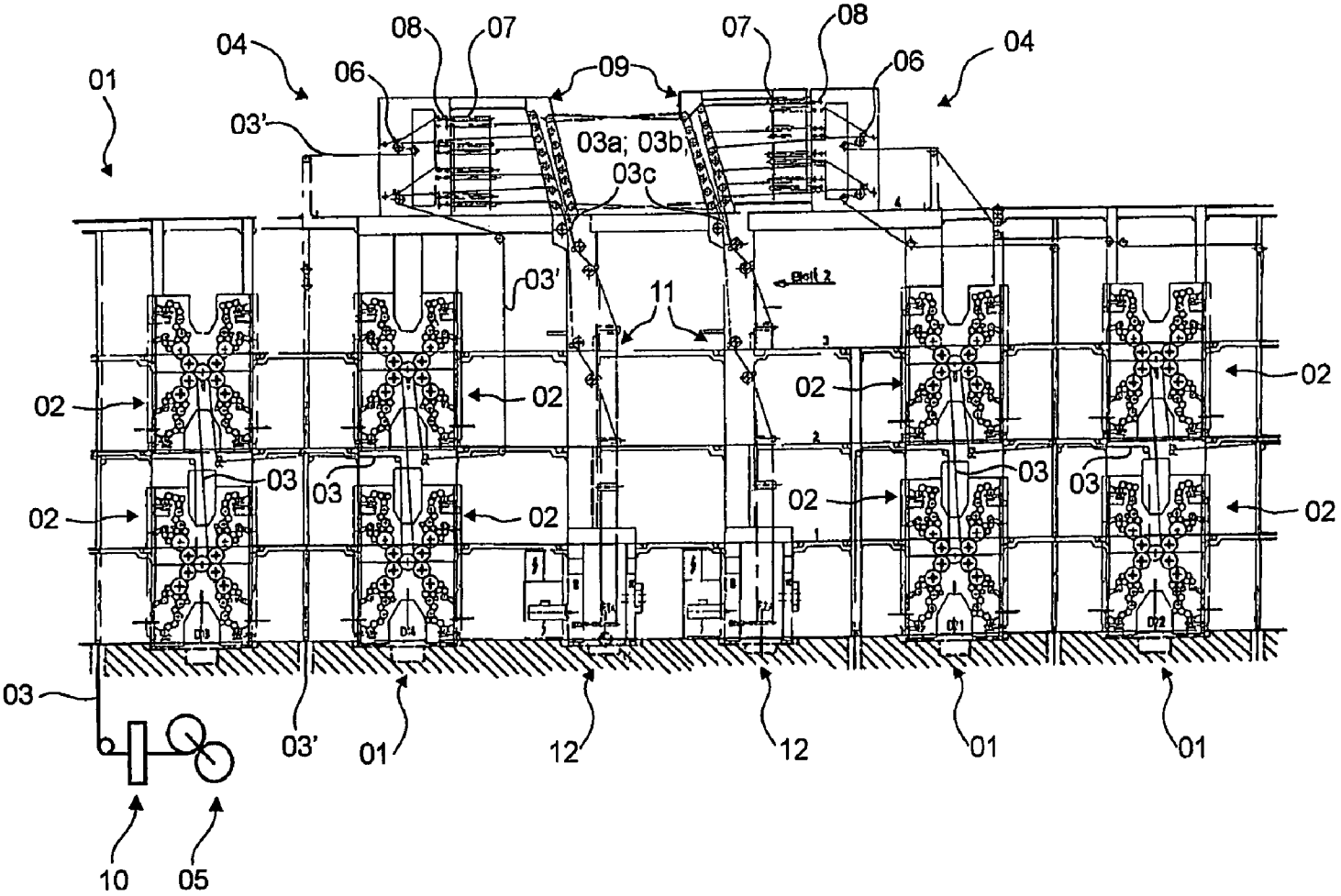

A web-fed rotary printing press, such as is represented in FIG. 1 by way of example, and in particular a newspaper printing press, has a left section and a right section, each with at least two printing towers 01. The printing towers 01 each have printing units 02 which are, for example, of at least triple width, and are embodied for printing six newspaper pages which are arranged respectively axially side-by-side. The printing units 02 are embodied as satellite printing units 02. An advantageous embodiment of each of the printing units 02, in the form of nine-cylinder satellite printing units 02, assures very good maintenance of the lateral register, or a small fan out. However, the printing units 02 can also be configured as ten-cylinder satellite printing units 02 or, if desired, as printing units which can be operated rubber-against-rubber, such as several bridge printing units, or as an H-printing unit 02, for example. The printing units 02 are supplied with webs 03 of material, such as, for example, with webs 03 from rolls, which are not specifically represented, in particular by the use of roll changers 05, via so-called draw-in groups 10, which are represented only once in FIG. 1 by way of example. In this case, more roll changers 05 and draw-in groups 10 can be provided than printing towers 01.

Downstream of a web 03 which is passing through the printing towers 01 or printing units 02, and in this case, above the printing towers 01, a superstructure 04 is provided for each section, in which the web 03, or webs 03, can be cut in longitudinal cutting devices 06, and in which partial webs can be offset and/or tipped, if required, by use of turning bar arrangements 07, so that the partial webs can be aligned, in respect to each other, in longitudinal registration by registration arrangements 08, which are only depicted schematically in FIG. 1, and can be conducted on top of each other. Viewed downstream in the web running direction, the superstructure 04 has at least one so-called harp 09 with a number of harp or winding rollers, which guide the webs 03, or the partial webs 03*a*, 03*b*, 03*c*. The harp 09 determines the former entry of the webs 03, or the partial webs 03*a*, 03*b*, 03*c*, which are conducted above each other. The webs 03, or the partial webs 03*a*, 03*b*, 03*c*, undergo a directional change by the use of this harp 09, and are subsequently combined into a continuous web or into several such continuous webs, and are conducted to at least one folding structure 11.

In the embodiment depicted in FIG. 1, two folding structures 11 are arranged between the printing tower sections, each of which has formers, which are, for example, arranged on two different levels on top of each other. However, the printing press can also merely have one common folding structure 11 which is arranged between the sections, or can also have only one section and an associated folding structure 11. The respective folding structure 11 can also be embodied with merely one level of formers. One or several folding apparatuses 12 are assigned to each folding structure 11.

Figure 2:
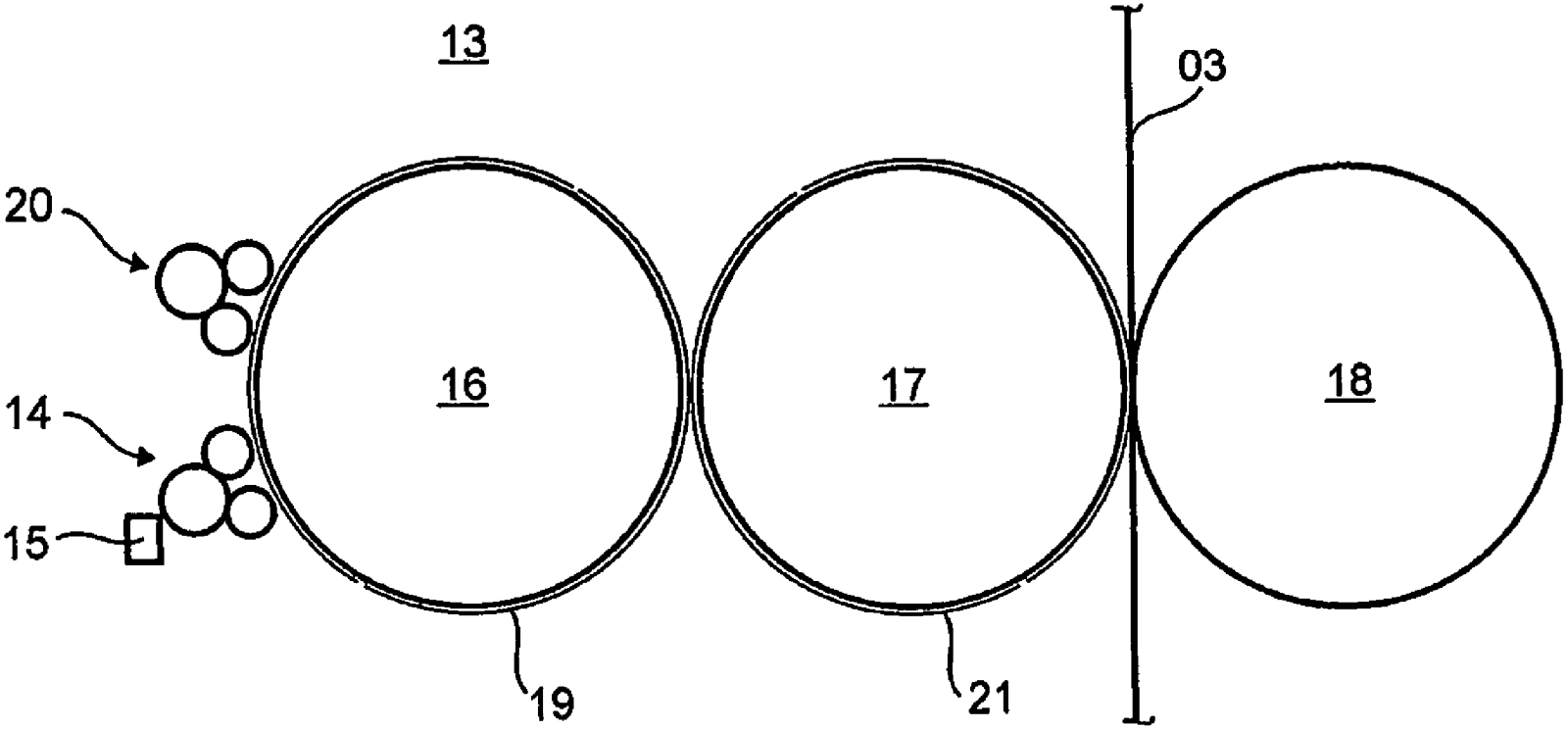

Each printing unit 02 has a plurality, and in the embodiment depicted in FIG. 1, has four printing groups 13, by the use of which printing groups 13, ink can be applied to the web 03 by at least one cylinder 16 which is embodied as a forme cylinder 16, as seen in FIG. 2. In the embodiment of the printing unit 02 as a satellite printing unit 02, each printing group 13 is configured as an offset printing group 13 for wet offset printing and has, in addition to the inking unit 14, a dampening unit 20 and a further cylinder 17, which is embodied as a transfer cylinder 17. Together with a printing cylinder 18, which constitutes a thrust element, the transfer cylinder 17 forms a print position. As represented by the example in FIG. 2, the printing cylinder 18 is preferably embodied as a satellite printing cylinder 18 which, together with at least one further transfer cylinder 17, constitutes at least one further printing group 13 and, in the print-on position, forms a further print position. In an embodiment of the printing groups 13 as double printing groups with rubber-against-rubber printing, the printing cylinder 18 could possibly also be embodied as a transfer cylinder. If not required for the purpose of making distinctions, similar elements are provided with the same reference numerals. However, a difference in the spatial position can exist, and, as a rule, such difference in spatial position is not considered in the case of the assignment of similar reference numerals.

In an advantageous embodiment, the inking unit 14 has an ink fountain 15 extending over six printed pages. In a different embodiment, three ink fountains 15, each approximately two printed pages wide, are arranged side-by-side in the axial direction of the forme cylinder 16. In an advantageous embodiment, the dampening unit 20 is embodied as a four-roller spray dampening unit 20.

In a first embodiment, the forme cylinder 16 has, for example, a circumference of between 850 and 1,000 mm, and in particular between 900 and 940 mm. The circumference is configured for receipt of two standing printed pages, such as, for example, two newspaper papers in broadsheet format, by the use of two dressings 19, such as, for example, two flexible printing formes 19, which can be fixed, one behind the other, in a circumferential direction on the forme cylinder 16. The printing formes 19 can be mounted in the circumferential direction on the forme cylinder 16 and, in the representation shown in FIG. 3, are respectively interchangeable as individual printing plates which are each provided with a printed page, in the axial direction of the forme cylinder 16.

Figure 3:
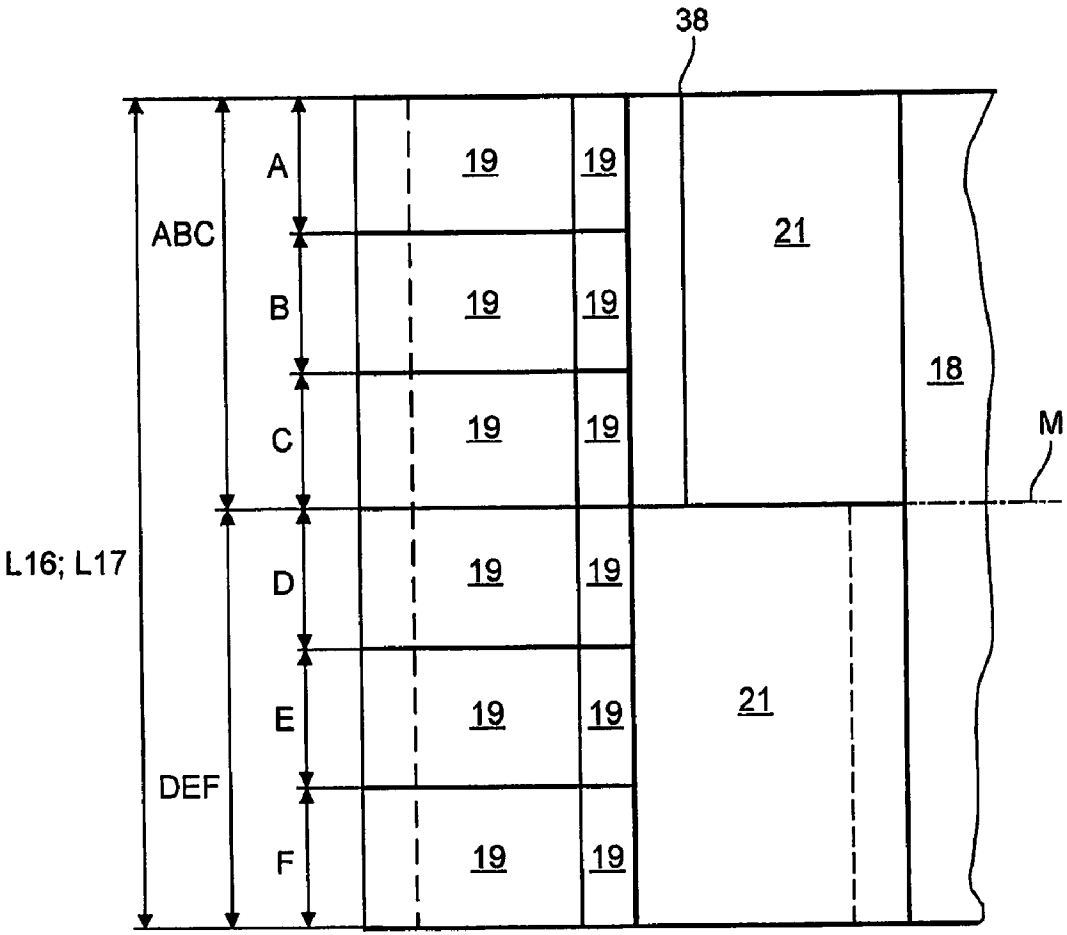

In the first preferred embodiment, a length L16, as seen in FIG. 3, of the usable barrel of the forme cylinder 16 is from 1,850 to 2,400 mm, for example, and in particular is from 1,900 to 2,300 mm, and, in the axial direction, the usable barrel is dimensioned for receiving, for example, at least six side-by-side arranged standing printed pages, and in particular six newspaper pages of various formats, such as, for example, in broadsheet format or in a format different therefrom, as may be seen in FIG. 3, at sections A to F. In this case, it depends, among other things, on the product to be provided whether only one printed page, or several printed pages are arranged side-by-side in the axial direction on a printing forme 19.

In a larger embodiment, the forme cylinder 16 has, for example, a circumference of between 980 and 1,300 mm, and in particular of from 1,000 to 1,200 mm. The length L16 of the usable barrel here is, for example, from 1,950 to 2,500 mm, and advantageously is from 1,950 to 2,400 mm, and in particular is from 2,000 to 2,400 mm. The plate placement corresponds to the above mentioned embodiment.

In the first embodiment, the transfer cylinder 17 also has a circumference of, for example, between 850 and 1,000 mm, and in particular from 900 to 940 mm. For example, the length L17 of the usable barrel of the transfer cylinder 17 is, in the first embodiment, also from 1,850 to 2,400 mm, and in particular is from 1,900 to 2,300 mm.

In the longitudinal direction, the transfer cylinder 17 is covered by dressings 21, each of a width of only three printed pages, such as, for example, printing or rubber blankets 21, depicted as sections ABC and EFG. In the circumferential direction, these blankets 21 extend substantially over the full circumference of the transfer cylinder 17. The rubber blankets 21 are arranged offset in the circumferential direction, for example by 180°, with respect to each other, as seen in FIG. 3 and advantageously affect the vibration behavior of the printing group 13 during operations.

In the larger embodiment, the transfer cylinder 17 has, for example, a circumference between 980 and 1,300 mm, and in particular from 1,000 to 1,200 mm. The length L17 of the usable barrel here is, for example, 1,950 to 2,500 mm, advantageously is 1,950 to 2,400 mm, and in particular is 2,000 to 2,400 mm. The placement of dressings 21 corresponds to the first embodiment.

The diameters of the barrels of the cylinders 16, 17 in the first, above-mentioned embodiment are, for example, between 270 and 320 mm, and in particular are approximately from 285 to 300 mm. In the second, above-mentioned embodiment, the diameters of the barrels of the cylinder 16, 17 lie, for example, between approximately 310 and 410 mm, and in particular lie between 320 and approximately 380 mm. A ratio of the length of the usable barrel of the cylinders 16, 17 and their diameters should be between 5.8 to 8.8, and, for example, should be around 6.3 to 8.0, in the wide embodiment, and in particular between 6.5 to 8.0.

In this case, the length L16, L17 of the usable barrel is to be understood to be that length or width of the barrel which is suitable for receiving dressings 19, 21. This also corresponds approximately to a maximally possible web width of a web 03 to be imprinted. Related to a total length of the barrel of the cylinders 16, 17, it would be necessary to add to this length L16, 17 of the usable barrel the width of also possibly provided bearer rings, of also possibly provided grooves and/or of also possibly provided shell face areas which must be accessible for operating various bracing and/or clamping devices.

In an advantageous embodiment of the present invention, the satellite cylinder 18 also has substantially the above-mentioned dimensions and ratios of at least the associated transfer cylinder 17.

As already mentioned above, the printing press is laid out for various product formats, or in other words for imprinting webs 03 of various widths. In this context, this does not mean a different width because of webs of partial width, such as would be the case with webs of "half", "one-third" or "two-third" width of the same basic width. In this case, the different web width is connected with a different product format, in which there is the same number of possible pages.

Figure 4:
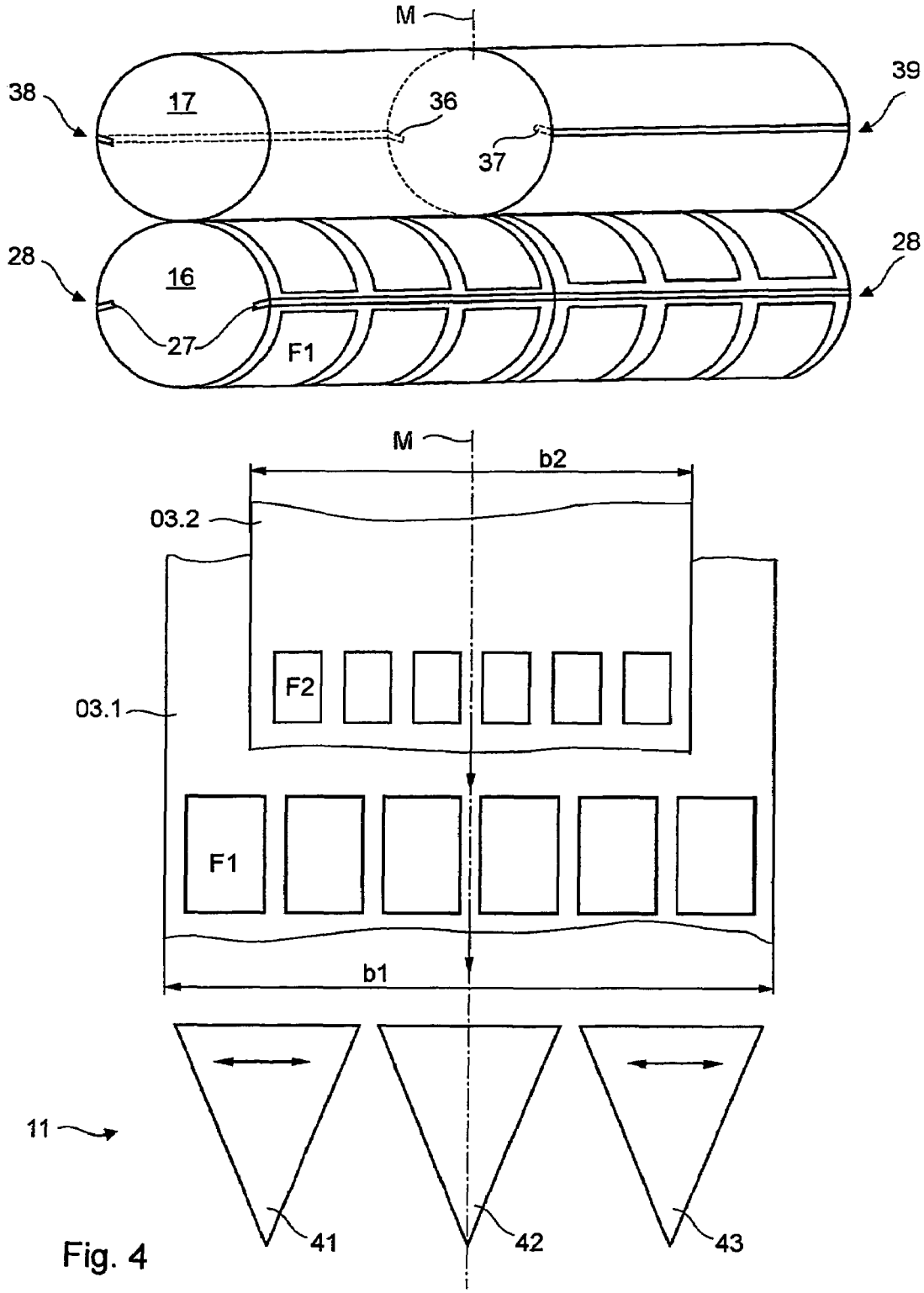
FIG. 4, a schematic representation of cylinders in a perspective plan view, together with a product to be further processed, in FIGS. 5*a* and 5*b*, a former group with a wide web and with a a narrow web, in FIG. 6, coverage of the printing group cylinders during newspaper printing in a first format, in FIG. 7, coverage of the printing group cylinders during newspaper printing in a second format, in FIG. 8, coverage of the printing group cylinders during newspaper printing with panorama printing formes, in FIG. 9, coverage of the forme cylinder in the course of asymmetrical division, in FIG. 10, further coverage of the forme cylinder in the course of asymmetrical division, in FIG. 11, a schematic representation of a three former production, straight ahead, for variable web widths, in FIG. 12, a schematic representation of a four former production, offset, for variable web widths, in FIG. 13, a schematic top plan view of a production in a special tabloid format, in FIG. 14, a schematic view of a production in accordance with FIG. 13, in FIG. 15, a schematic view of a production, straight ahead, in a special tabloid format, in FIG. 16, a schematic view of a production in accordance with FIG. 15, in FIG. 17, a schematic view of a production in a special format with a plow fold, in FIG. 18, a further schematic view of a production in a special format with a plow fold, in FIG. 19, a dressing in a perspective representation, in FIG. 20, a holding element in a groove of a forme cylinder, in FIG. 21, a slightly vertically offset former arrangement, in FIG. 22, a former with removable edge areas, in FIG. 23, a schematic representation of shutters in a dampening unit, in FIG. 24, a schematic representation of a roll changer, in FIG. 25, a first preferred embodiment of a traction group, in FIGS. 26*a* and 26*b*, a second preferred embodiment of a traction group with a wide web and with a narrow web, in FIGS. 27*a* and 27*b*, a preferred embodiment of a longitudinal cutting device with a wide web and with a narrow web, in FIGS. 28*a* and 28*b*, a first preferred embodiment of a turning arrangement with a wide web and with a narrow web, in FIGS. 29*a* and 29*b*, a second preferred embodiment of a turning arrangement with a wide web and with a narrow web, FIGS. 30*a* and 30*b*, two variations of a machine configuration with a turned folding structure, in FIG. 31, a machine configuration with two sections, in FIG. 32, a folding structure with a folding apparatus, in FIGS. 33*a* and 33*b*, a schematic representation of a printing group of a width of four newspaper pages in the course of printing a wider web and a narrower web, in FIG. 34, a further preferred embodiment of a printing press, in FIG. 35, a further preferred embodiment of a printing press, and in FIG. 36, a further preferred embodiment of a printing press.

In a particularly advantageous embodiment of the present invention, the forme and transfer cylinders 16, 17 are covered with dressings 19, 21, as represented in FIG. 3. A particularly advantageous arrangement of grooves 27, 36, 37, for use in fastening the dressings, 19, 21 is represented in FIG. 4. On the forme cylinder 16, two grooves 27, each extending over the effective length of the forme cylinder 16 and being spaced apart from each other by 180° in the circumferential direction, or two groove openings 28 or openings 28, are provided. At the transfer cylinder 17, two grooves 36, 37, each extending over half the effective length and offset by 180° in the circumferential direction, or groove openings 38, 39 or openings 38, 39, are also provided. In FIG. 4, the grooves 27, 36, 37 are only represented in a slit form for the insertion of ends of blankets, but can open into the interior, as represented below, for receiving an appropriate blanket or dressing end bracing and/or clamping device.

The printing group 13, having a forme cylinder and a transfer cylinder 16, 17, for imprinting a variable web width, is schematically represented in FIG. 4, together with a folding structure 11, which will be described in greater detail below, and being operable with two web widths. In a first mode of operation, a web 03.1 of a first width b1 is used for imprinting with a first printed page format F1, and in a second mode of operation, a web 03.2 of a second width b2 is used for imprinting and can be imprinted with a smaller, second printed page F2. The transfer cylinder 17 has a width, in the axial direction, of at least six widths of a newspaper page of the larger printed page F1 and has two printing blankets next to each other in the axial direction, each of which printing blankets has a width, in the axial direction, of three widths of a newspaper page of at least the smaller format F2, such as, for example, of printed page format F2, and better yet of the larger format F1, such as, for example, printed page format F1.

A number of the printed newspaper pages, when viewed in the axial direction, is, for example, the same in the first mode of operation, for newspaper printing, F1, and the second mode of operation, for newspaper printing, F2. Preferably, it amounts to six pages of the respective format F1, F2.

The greater width b1 is suited for imprinting six side-by-side arranged newspaper pages in the first format F1 and lies, for example, between 1,800 to 2,500, advantageously lies between 1,900 to 2,400 mm, and in particular lies from 1,900 to 2,200 mm. The lesser width b2 is suitable for imprinting six side-by-side arranged newspaper pages of the second format F2 and lies, for example, between 1,750 to 2,100, advantageously lies between 1,750 to 2,050 mm, and preferably lies between 1,850 and 1,950 mm, wherein b1>b2 applies, however. The possible widths for newspaper printing are not to be applied only to the two above-mentioned widths or formats, but to every arbitrary one lying between them. This means that basically all webs 03 of the most different widths, or corresponding newspaper formats are variable, which lie, for example, between 1,750 mm and 2,400 mm, and which at least lie between 1,850 and 2,200 mm.

An imaginary printing press center axis M is also indicated in FIGS. 3 and 4. The two dressings 21 are arranged symmetrically with respect to this printing press center axis M. The web 03.1, 03.2 passes through the printing groups 13, independently of the width b1, b2, symmetrically with regard to this printing press center axis M.

In at least one of the modes of operation, the forme cylinder 16 of the printing group 13 has, for example, one printing forme 19", as will be discussed below, which extends in the axial direction over at least three newspaper page widths of the actually used format F1, F2. In this case, it is provided with, in particular is exposed to, for example, side-by-side print images of three newspaper pages, or a print image corresponding to a total width of three newspaper pages. Also, the former tip of a center one of the three side-by-side arranged formers 41, 42, 43 of the folding structure 11 is located on the printing press center axis M, as will also be discussed below.

Figure 5:
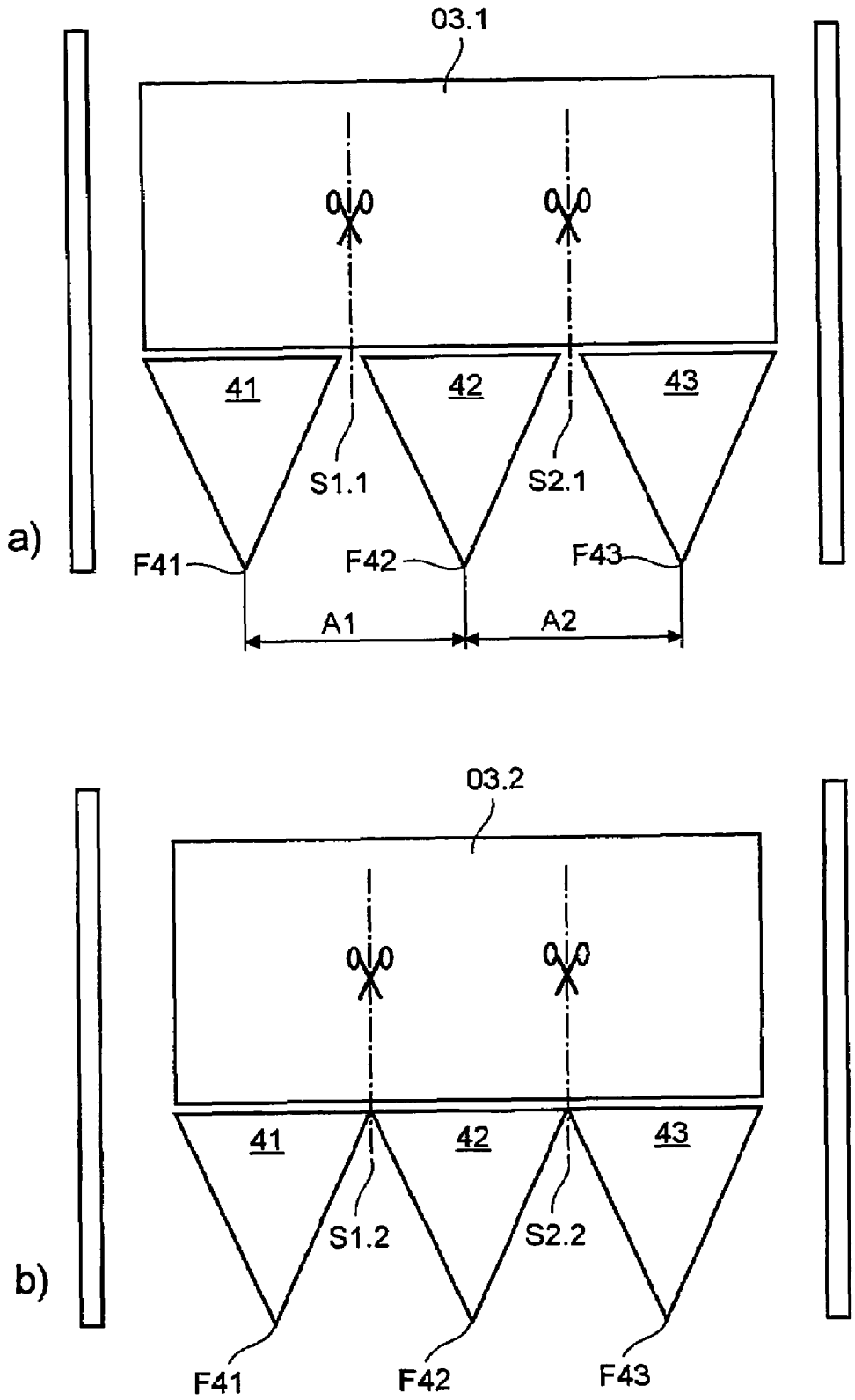

FIG. 5 schematically shows the circumstances in connection with a wide web 03.1, as seen in FIG. 5*a* and a narrow web 03.2, as seen in FIG. 5*b*, wherein the main cutting lines S1 and S2 for the two different product widths, or web widths are also represented. Here, "main cutting lines" are understood to be the longitudinal cuts which separate the web 03 in an alignment between two adjacent formers 41, 42, 43, so that the partial webs which are formed, can be conducted over the adjacent formers 41, 42, 43. In this case, the additions "1" and "2" (S1.1, S2.1, S1.2, S2.2) indicate that these are, respectively transversely to the transport direction, a first position and a second position, different from the first one, of the respective main cutting lines S1, S2 corresponding to the two different formats F1, F2 of the product, or the two different widths b1, b2 of the webs 03.1, 03.2. The longitudinal cuts along the main cutting lines S1 and S2 can be made by the longitudinal cutting device 06 mentioned in connection with FIG. 1, or by a comparable longitudinal cutting device, which is not represented in FIG. 1, and which is located upstream of the former inlet. A particularly advantageous embodiment of a longitudinal cutting device, 06, 65 suitable for this is discussed below.

Folding levels, which represent the planes of symmetry of the respective formers 41, 42, 43 and in which the former tips are located, if they are correspondingly configured, are also represented in FIGS. 5 to 10 and are identified by F41, F42, F43. In this case, it is possible to see that a distance A1 between the folding planes F41 and F42, as well as a distance A2 between the folding planes F42 and F43 varies as a function of the width b1, b2 of the web 03.1, 03.2 and/or of the actual printed page format and/or the manner of the occupation with print images, symmetrical or asymmetrical. These varied distances are preferably achieved by moving the outer formers 41, 43, while the center former 42 remains stationary. It is possible to provide extra cutting lines S4, S5, which are not represented in FIGS. 5, to 12, however, for example, in addition to the above mentioned main cutting lines S1, S2, in the folding level F41, in the folding level F42 and/or in the folding level F43 wherein, in the case of an extra section, no longitudinally folded product, but a multi-layered product, which has been cut along the spine and which is lying loosely stacked, is formed. See the tabloid production depicted in FIGS. 13 to 16, as well as the special format with plow fold, shown in FIGS. 17 and 18.

Advantageous placements and configurations of the dressings 19, 21, in particular of the printing formes 19, for the wider and the narrower webs 03.1, 03.2 are represented in FIGS. 6 to 10. However, the represented dressings 19, 21 depicted there do not correspond to a view from above, but instead correspond to a complete revolution of the respective cylinders 16, 17.

In connection with all of the following embodiments of FIGS. 6 to 10, the transfer cylinder 17 is equipped with two dressings 21 of the larger format side-by-side in the axial direction, each of which is three printed pages wide. In an advantageous embodiment, these two dressings 21 can each extend over the entire cylinder circumference, and can either be aligned with their ends in the same joints in the groove openings 38, 39, or can be arranged offset by 180° from each other in the circumferential direction. In another embodiment, two dressings 21 can respectively be arranged, one behind the other, in the circumferential direction. The ends of the two dressings 21, which are respectively arranged side-by-side and which are of a width of three printed pages, are aligned with each other. In every case, it is advantageous if the two axially side-by-side arranged dressings 21 together extend at least over that length of the transfer cylinder 17 which is required for imprinting the wider web 03.1.

Figure 6:
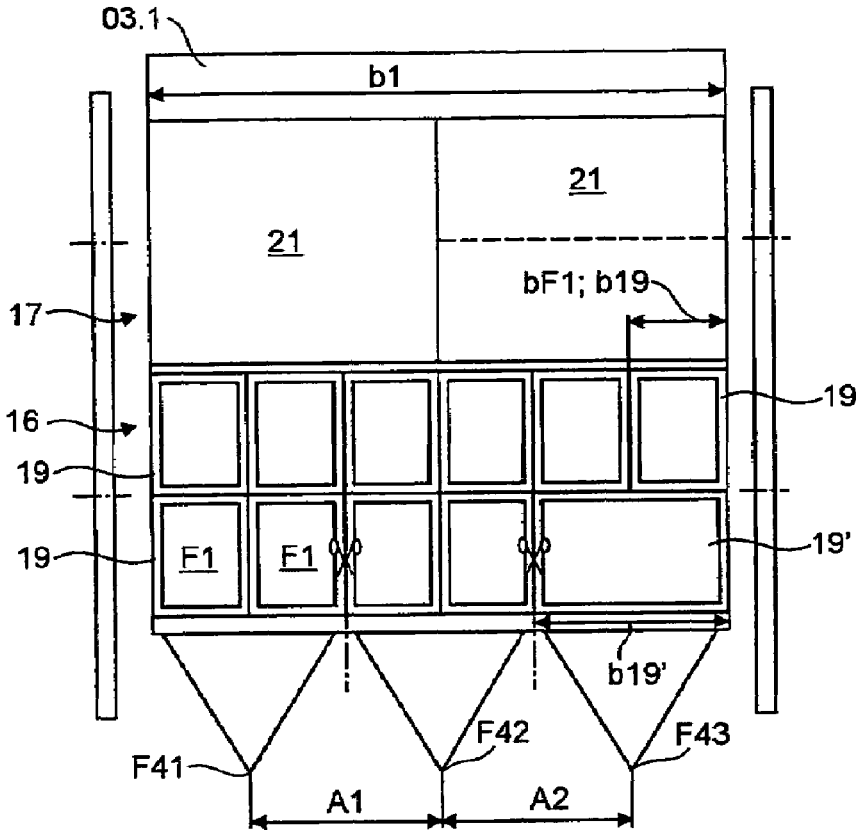
Figure 7:
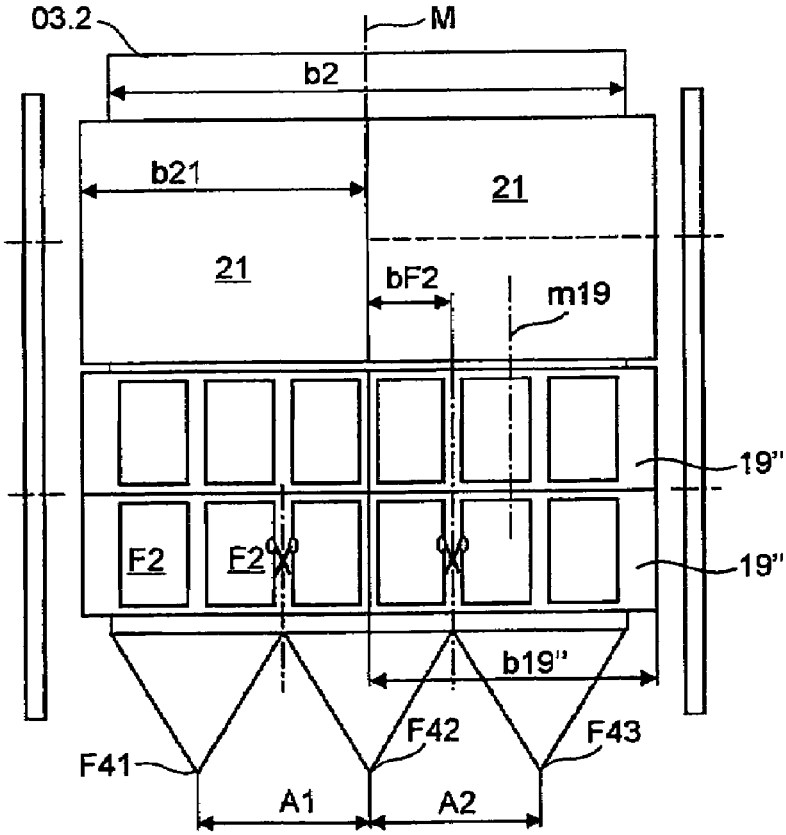
Figure 8:
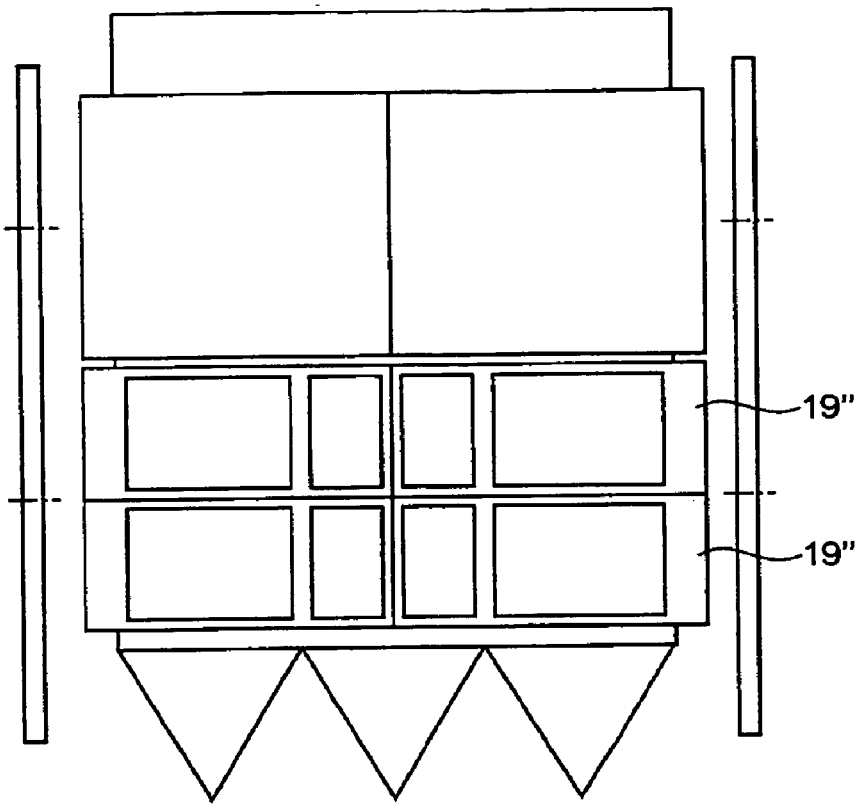
Figure 9:
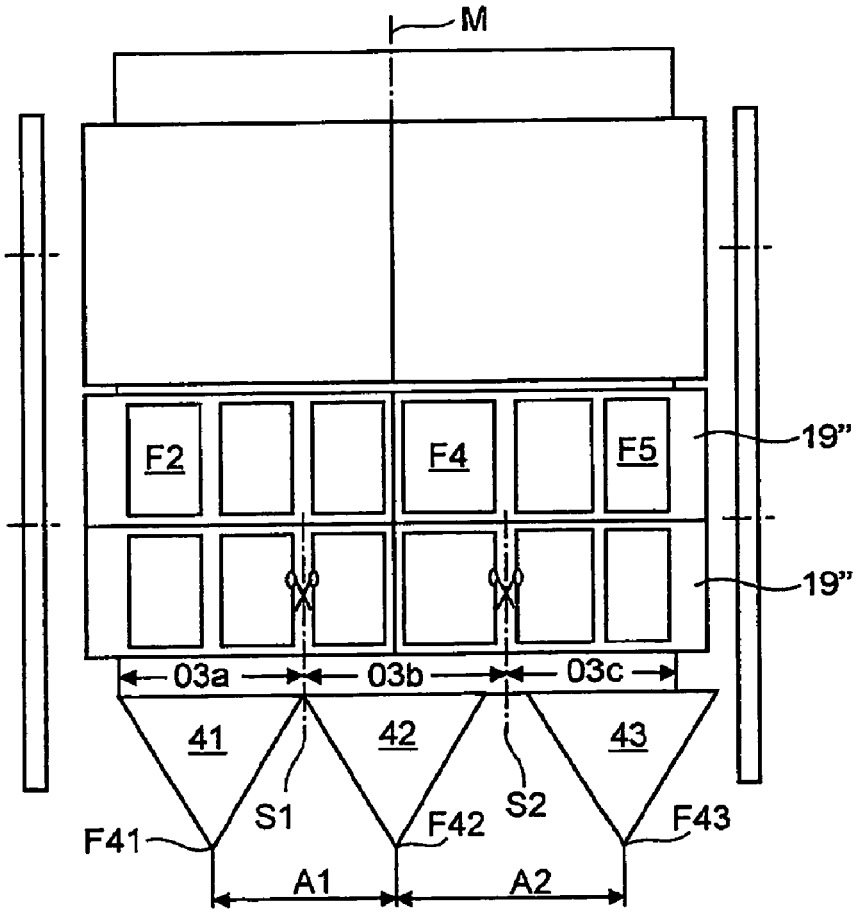
Figure 10:
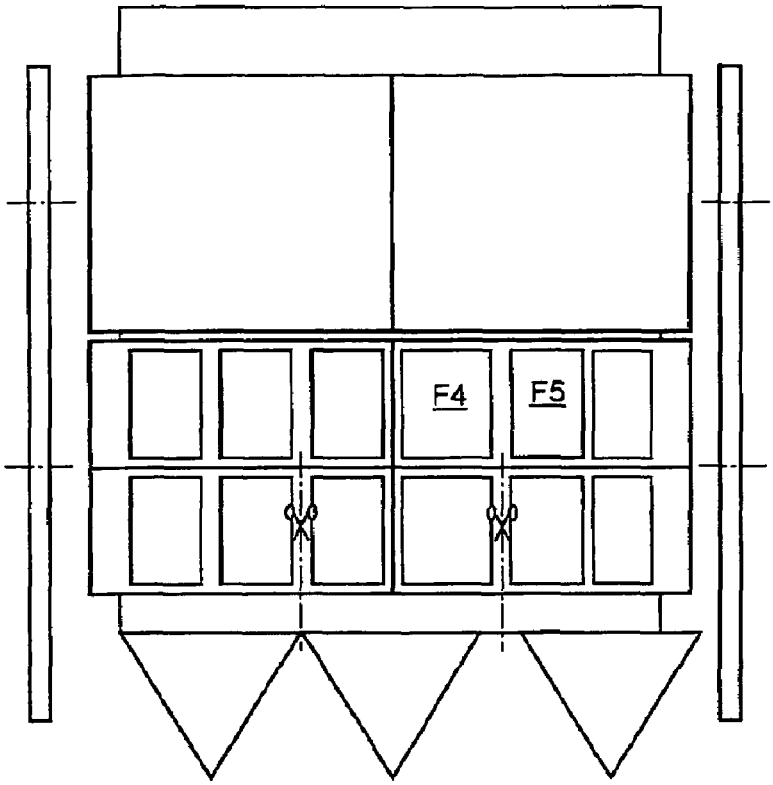

A preferred variation for covering the transfer cylinder 17 is shown in dashed lines in FIGS. 6 and 7, and consists namely of two dressings 21, each of a width of three printed pages, and each extending over the entire circumference. The embodiment of a width of three printed pages is represented in FIGS. 8, 9 and 10 in the axial direction, but in which embodiment the length in the circumferential direction has been left open, and can be one of the above mentioned variations.

FIG. 6 shows the occupation of the forme cylinder 16 with printing formes 19, 19' in the type or mode of operation in which the print images have the larger printed page format F1. The web width corresponds to the larger width b1. In this case all of the here depicted twelve printing forms, which are embodied as individual printing formes 19, can be arranged. However, combinations of individual printing formes 19 and of panorama printing formes 19' can also be placed, as shown, by way of example, in the lower right of FIG. 6. The latter have a width of several, such as, for example, of two or even three, individual printing formes 19 and either have a print image several pages wide, for panorama printing plates, or several, such as one or several pages wide print images, respectively of the first, larger print page format F1. A differentiation is made here between a panorama printing form 19', 19" and the panorama print image or printed page. In this sense, a panorama printing forme 19', 19" can have individual or panorama printed pages. The distances A1 and A2 in FIG. 6 respectively correspond to twice the width b19 of an individual printing forme 19, or twice the width of a printed page bF1 of the larger format F1, or the width b19' of a panorama printing forme 19', or a panorama print image of the larger format F1. The printing formes 19, 19', 19" are preferably embodied as planographic printing formes for use in offset printing.

In contrast to FIG. 6, FIG. 7 shows the coverage of the forme cylinder 16 with printing formes 19" which are provided in the type or mode of operation in which the forme cylinder 16 has print images of the smaller print page format F2. The web width corresponds to the smaller width b2. In this case, and in an advantageous embodiment, two panorama printing formes 19" are each arranged symmetrically with respect to the printing press center axis M, each of which has a width of several, such as, for example, two, and in particular has a width of three, non-represented theoretically required individual printing formes of the smaller format F2 and which have, either as represented in FIG. 7 several, and, in particular three in this case, print images of a width of one printed page of the second, smaller printed page format F2 or, as shown in FIG. 8, respectively one print image of a width of several printed pages and a print image of a width of one printed page. In FIG. 7 the forme cylinder 16 is constructed with twice the circumference, or two newspaper pages on the circumference with four such printing formes 19", two arranged side-by-side and two positioned one behind the other, each of which printing formes 19" has three side-by-side print images of the smaller printed page format F2. For forme cylinders 16 of single circumference, only two such printing formes 19" would be provided side-by-side. In FIG. 8, the printing formes 19" each have one print image of a width of several printed pages and one print image of a width of one printed page. However, mixed variations are also possible, but are not represented here. The distances A1 and A2 in FIGS. 7 and 8 respectively correspond to twice the width of a potential, but not specifically represented, single page printing forme, or to twice the printed page width bF2 of the smaller format F2.

Preferably, the printing formes 19" of the smaller printed page format F2 have not only the width of the three printed pages, but also extend to the end of the effective shell face of the forme cylinder 16. Therefore, the two side-by-side arranged printing formes 19" together have a width corresponding to the maximum, or the larger width b1 of the wider web 03.1. Therefore, a more even transport behavior is possible over the entire effective length L16 of the forme cylinder 16, regardless of the most recently used web width. The danger of a drying-out of the corresponding dressing 21 in the edge zones is also reduced, when using the narrower web 03.2. In this case, the printing forms 19" have the print images located asymmetrically, in respect to their width, and are asymmetrically exposed when they are produced, for example. The non-printing edge area is 50 to 100 mm.

FIGS. 9 and 10 show the coverage of the forme cylinder 16 with printing formes 19" each of a width of three printed pages, printing formes 19" which have been asymmetrically provided with print images. Two print images which are located on a printing forme 19", such as for example, format, or printed page format F4 and F5 do not have a whole number ratio of their width. Here, for example, the cutting lines S1.*x*, S2.*x* are not located symmetrically in regard to the printing press center axis M. The distances A1 and A2 are, for example, different from each other. At least with one of the three formers 41 to 43, shown here at 42 and 43, the folding level F41, F42, F43, and here F42, F43 does not coincide with the center of the associated partial web 03*a*, 03*b*, 03*c*, here 03*b*, 03*c*, so that the longitudinally folded, partial continuous web being formed has unequal leg lengths.

Figure 11:
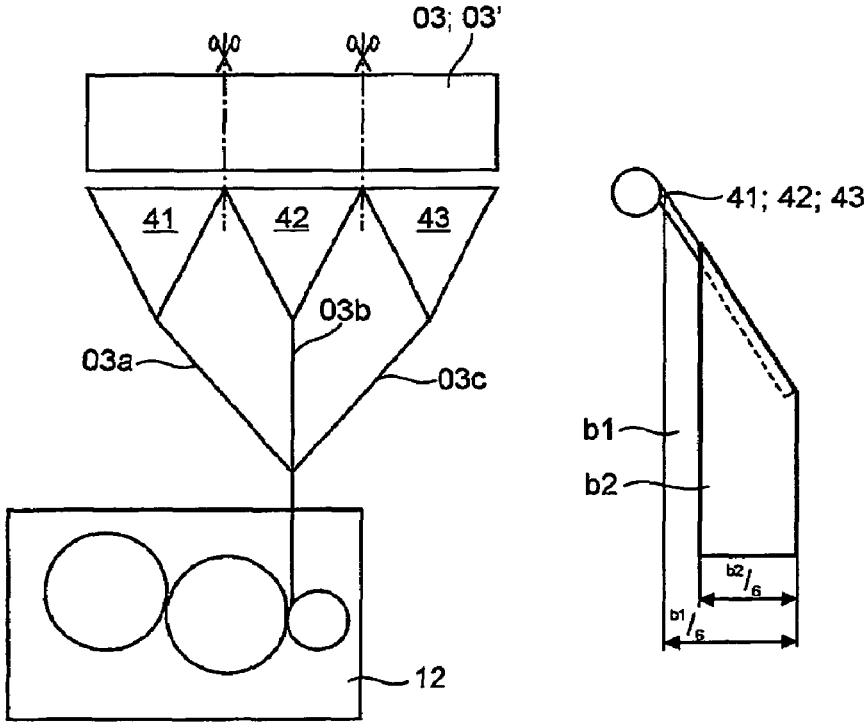

FIG. 11 shows the course of a web of a production, wherein the longitudinally cut partial webs 03*a*, 03*b*, 03*c* of one or of several webs 03, 03', which had been imprinted in a printing tower 01, or in several similar printing towers 01, run up straight, and without turning on the three side-by-side arranged formers 41 to 43, are longitudinally folded there and are finally conducted to the folding apparatus 12. The former 41, 42, 43, which is schematically represented in a lateral view of FIG. 11, has a total usable leg length which corresponds to at least one-sixth of the width b1 of the wider, or widest web 03.1 (b1/6). Also indicated here is a continuous web width which results, in the course of the production, with the narrower width b2 in b2/6.

Figure 12:
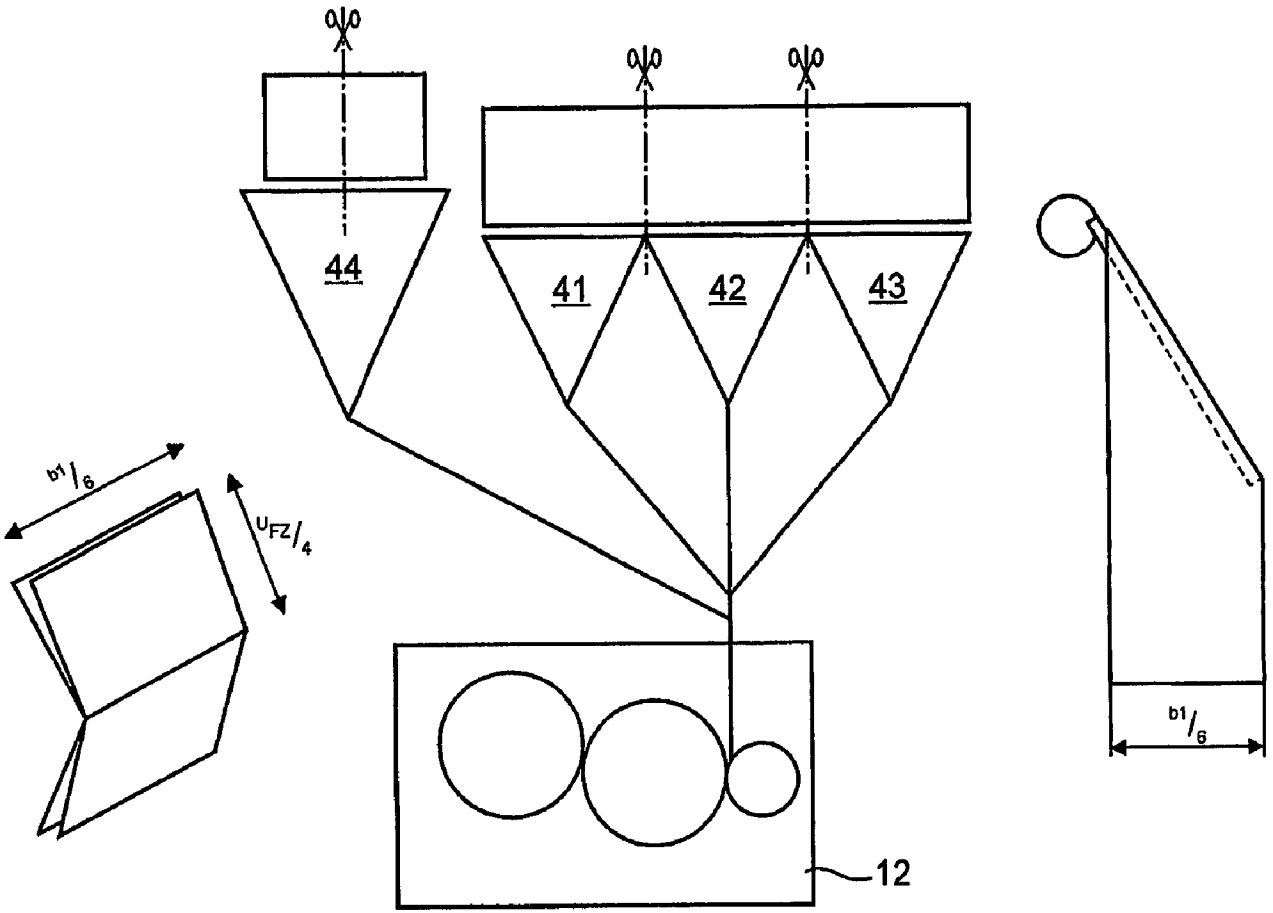

FIG. 12 is a representation, which is comparable to FIG. 11, wherein, in addition to the three formers 41 to 43, a further former 44 is arranged, in particular laterally, with respect to the other three. By the use of this, at least one cut partial web 03*a* to 03*c* is turned out of the straight run in a so-called "4-former production", is conducted over this fourth former 44 and is finally conducted to the folding apparatus 12 in addition to the other continuous webs. Each of the four formers 41 to 44 has a totally usable leg length corresponding to at least one sixth of the width b1 of the wider, or widest, web 03.1 (b1/6).

In an advantageous variation, the printing press is operated, or can be operated, in one mode of operation for printing six side-by-side arranged standing printed pages of a format F1, F2, configured as a newspaper format F1, F2, on a suitably wide web 03.1, 03.2, and in another mode of operation, the printing press can be operated for printing four side-by-side arranged horizontal printed pages of a format F3 configured as a tabloid format F3. A first preferred embodiment is shown in FIGS. 13 and 14, and a second preferred embodiment is shown in FIGS. 15 and 16.

Figure 13:
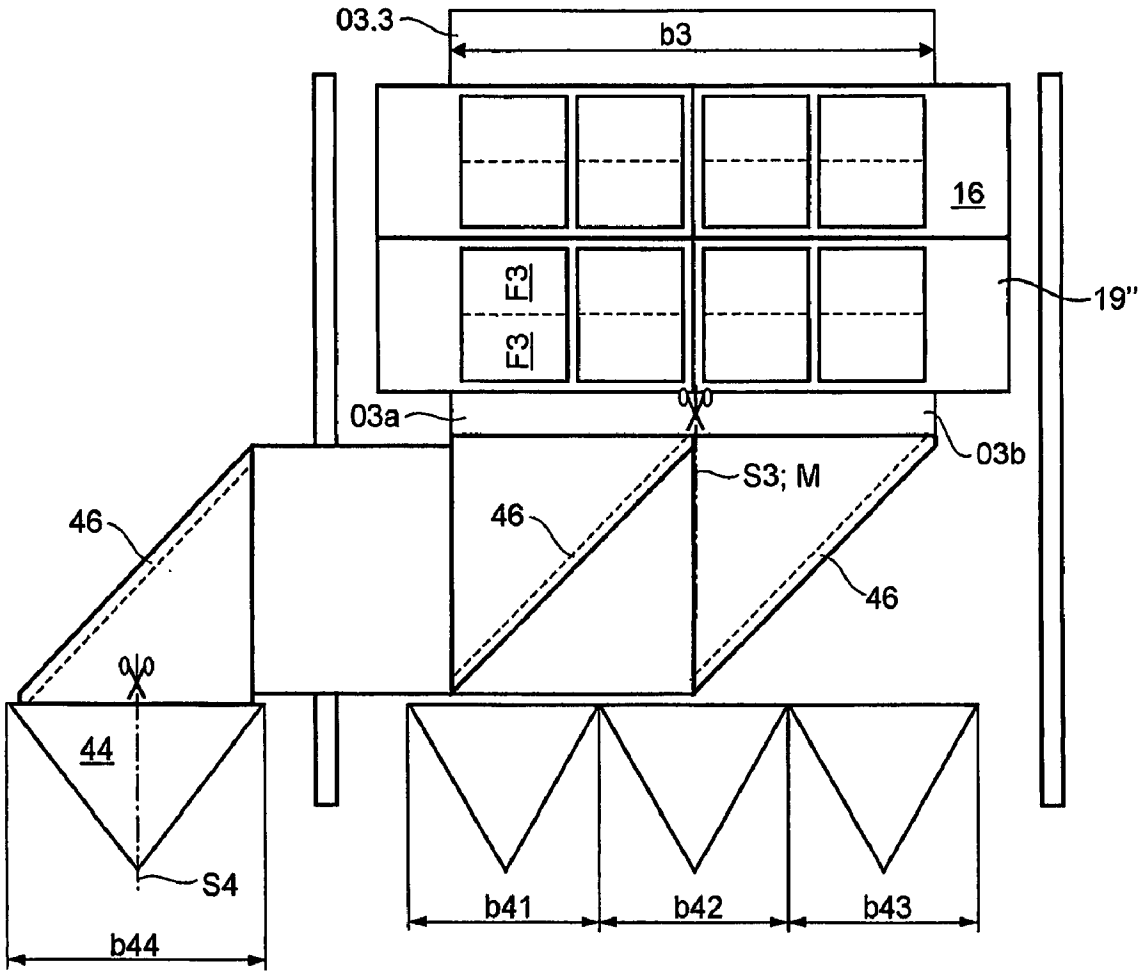
Figure 14:
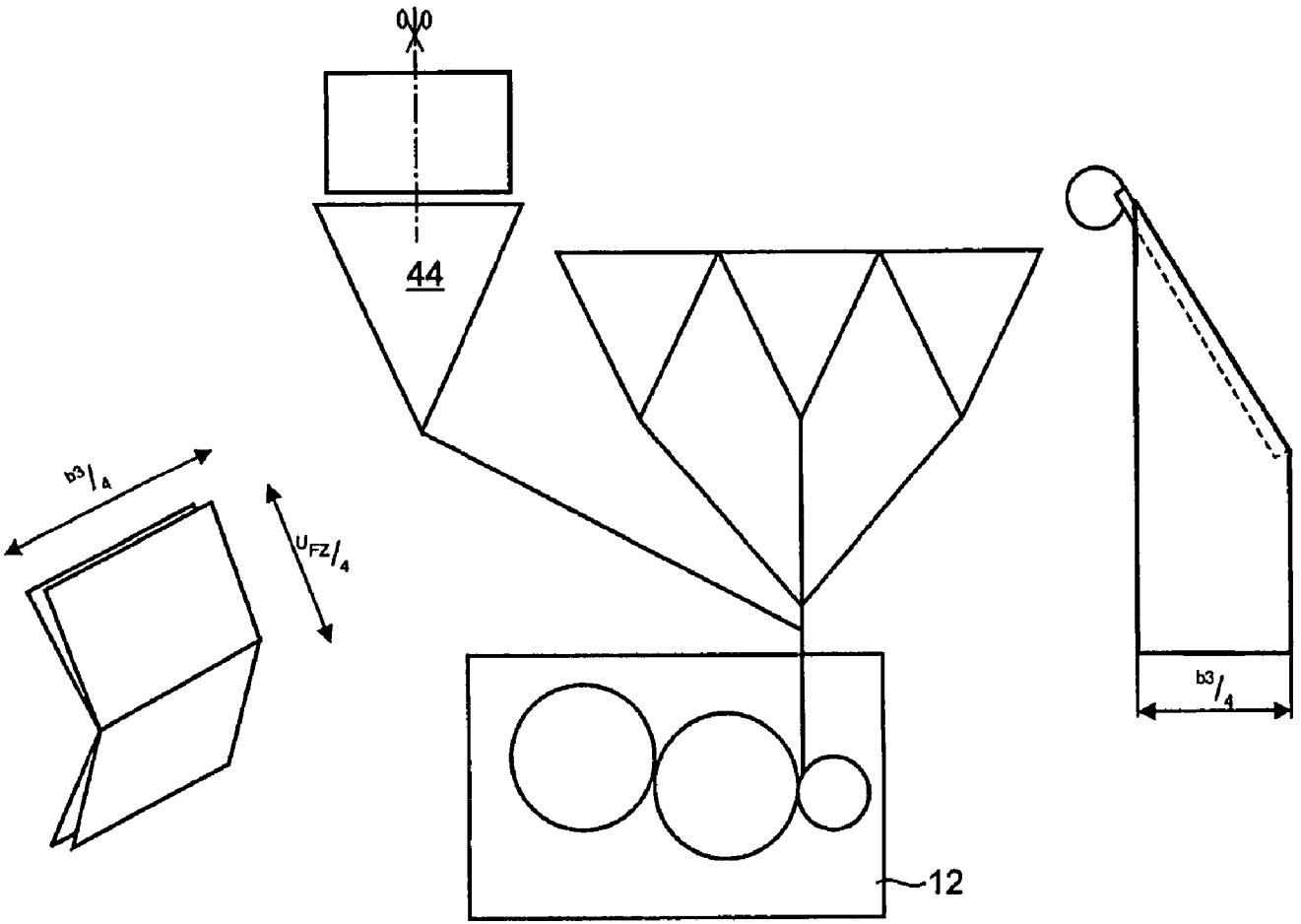

Anticipating what will be stated in connection with FIGS. 13 and 14, the fourth former 44, in the form of an additional former 44 in FIG. 12, can, in a first embodiment of the above mentioned variation, have a greater maximum width in comparison with the formers 41 to 43, or in other works can have a usable maximum leg length, which clearly corresponds to more than one-sixth of the width b1 of the wider, or widest, web 03.1 (b1/6), and in particular which corresponds to at least 120% of one-sixth of the width b1 of the wider web. Because of this, it is also possible to operate a production, such as format F3 which is represented in FIGS. 13 and 14, selectively in addition to a newspaper production, such as format F1, F2. In FIG. 13, the forme cylinder 16 which, in particular, is six newspaper pages wide, is again equipped with only two panorama printing forms 19" in the axial direction which, however, have print images in tabloid format F3, and not in newspaper format. The incoming web 03.3 here has a further width b3 which is different from the first and second web widths b1, b2. With their subsequent production length, following transverse folding, the print images lie in the axial direction of the forme cylinder 16 and each correspond to one-fourth of the width b3 of the web 03.3 (b3/4), as seen in FIG. 14. After a completed, not represented, transverse fold, the product width substantially results in one-quarter of the circumference $U_{FZ}$ of the forme cylinder ($U_{FZ}/4$). For example, the width b3 is less than the other two widths b1, b2 and lies for example from 1,600 to 1,800 mm, and preferably is between 1,700 and 1,750 mm. The imprinted web 03.3 is here longitudinally cut in the center along a main cutting line S3 of the tabloid format, preferably coincides with the printing press center axis M. Both partial webs 03*a*, 03*b* are turned, by the use of respective turning bars 46 by 90°, out of their former transport direction toward a long side of the printing press, and are conducted out of the alignment of the three formers 41 to 43, whereupon they are conducted either transversely, with respect to the printing press center axis M via an appropriately oriented former 44, or, as represented, after an additional deflection at a further turning bar 46 by 90° via the correspondingly oriented former 44, to the folding apparatus 12. Again, the former 44 has a greater maximum width, in comparison with the formers 41 to 43, or in other words has a usable maximum leg length which clearly corresponds to more than one-sixth of the width b1 of the wider, or the widest web 03.1 (b1/6), and in particular which corresponds to at least 120% of one-sixth of the width b1 of the wider web 03.1. The tabloid product is finished in the folding apparatus 12, by, among other processes, transverse cutting. Thus, the former 44, in tabloid format F3 or the group of formers 41 to 43, in newspaper format F1 and/or F2 are selectively employed for the selective production of tabloid or of newspaper products.

Figure 15:
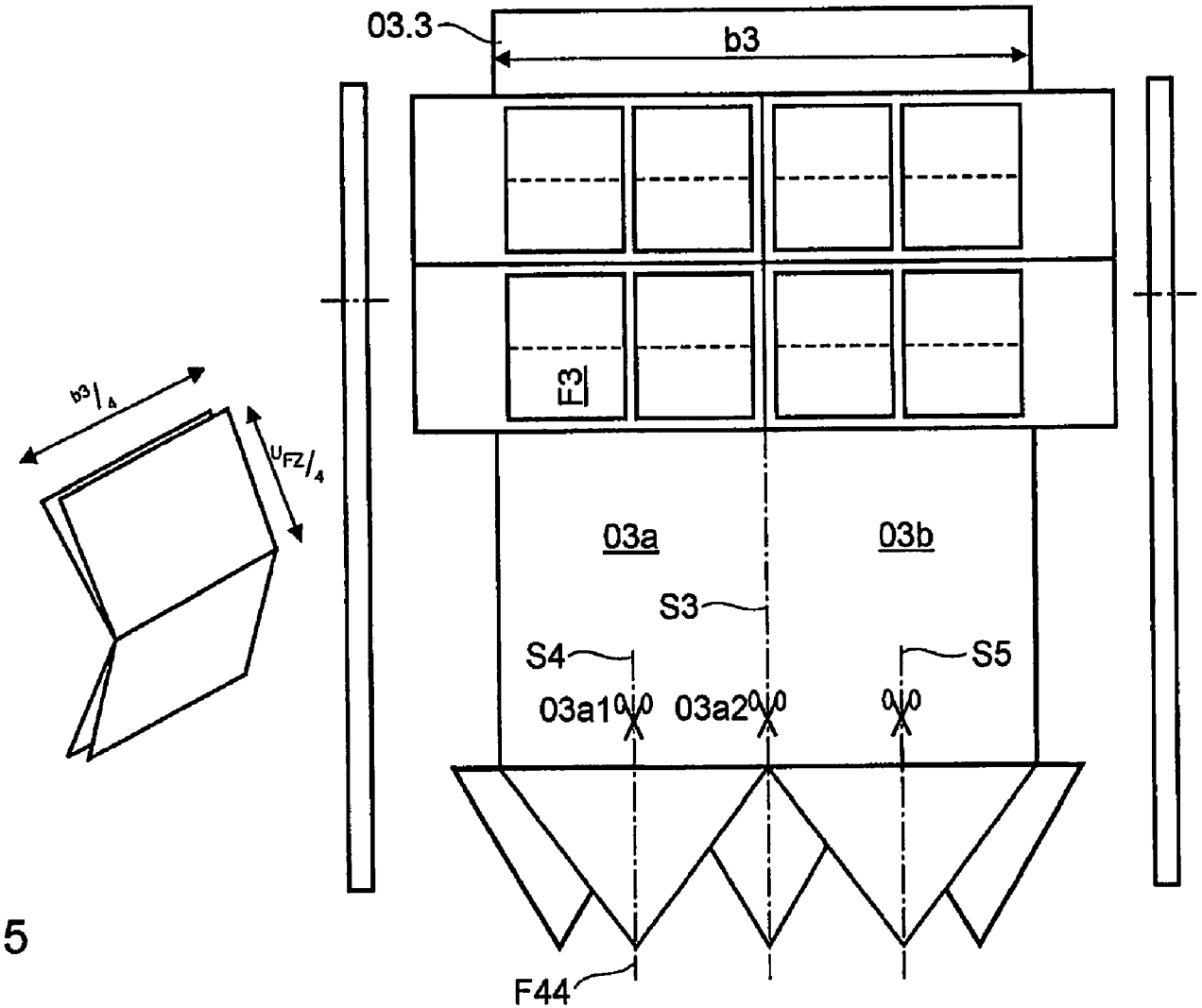
Figure 16:
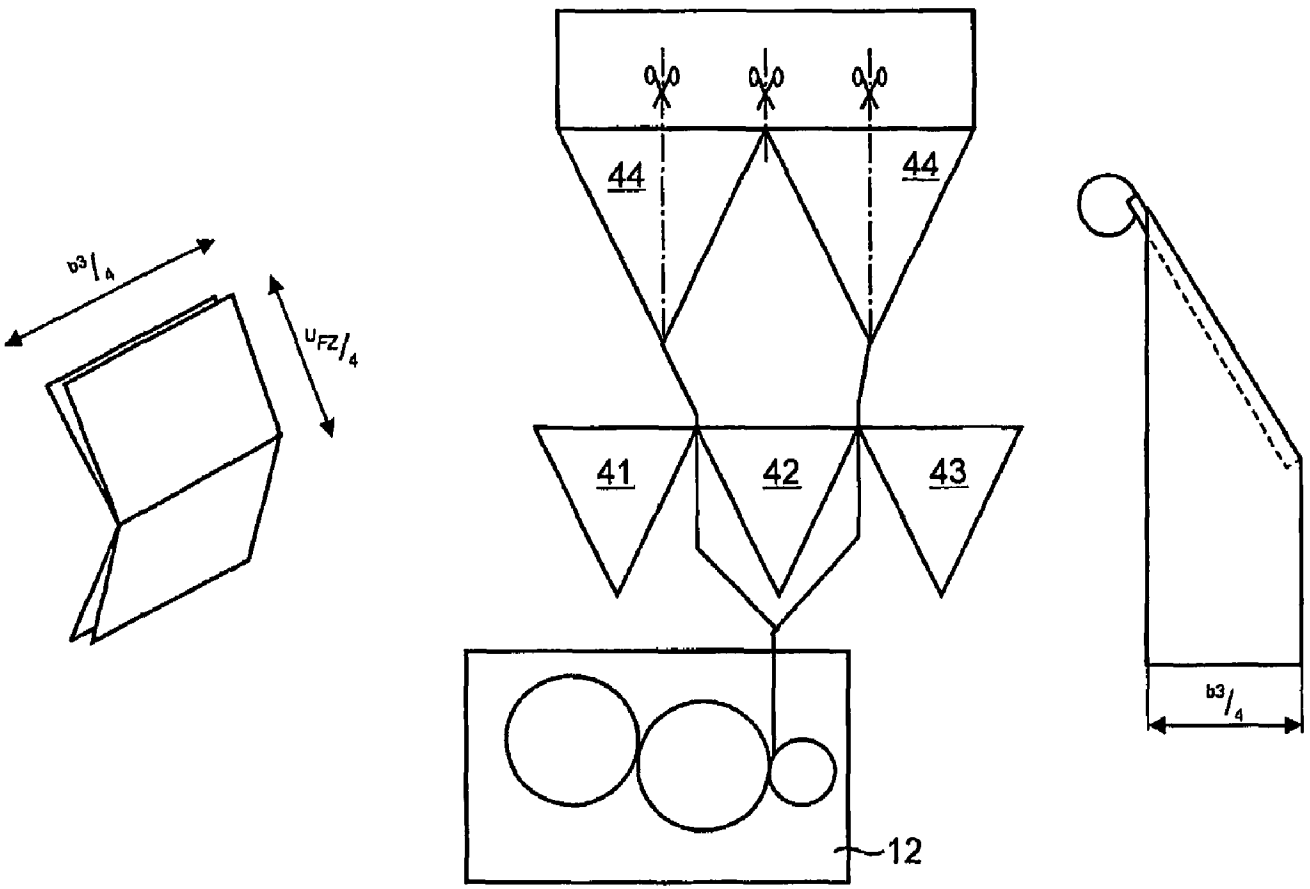

In the second embodiment of the above mentioned variation, as seen in FIGS. 15 and 16 the added former 44 is not arranged next to the press level or next to the group of formers 41 to 43, but is situated within the alignment of the press, and in particular, is located above or below this group. This can be a single former 44 arranged in the path of the web 03 or, as represented, can preferably be two such formers 44 which can be arranged side-by-side in the path of the web 03 in such a way that the two, or half partial webs 03*a*, 03*b*, or the partial webs 03*a*.1, 03*a*.2, of a width of half a former, which are formed by two respective further cuts along the extra cutting lines S4, S5, and wherein only the partial web 03*a* is shown by way of example, run up on the formers 44 in a straight line, so that they need not necessarily be turned. Thus, in one mode of operation, such as, for example, in the case of newspaper production, production is run on the group of formers 41 to 43 of a width b1 or b2 of the original web 03.1, 03.2 while, in another mode of operation such as, for example, in connection with tabloid production, production is run on the former 44, or on the group of formers 44, with the original web 03.3 of a width b3. Regarding the width of the former 44 and the width b3, what was said above again applies.

In an advantageous embodiment, the extra cutting lines S4 and S5 can be produced in the above-mentioned tabloid mode of operation by use of the same cutters, as discussed below as the main cutting lines S1 and S1 in the other mode of operation for newspaper printing, but which cutters are appropriately differently positioned. Thus, for example, three cutting units, which are arranged axially side-by-side, are sufficient. A center one, viewed in the axial direction, for example, is stationary in the printing press center axis M, and the two outer ones are arranged so they can be positioned, or moved, in the axial direction.

Figure 17:
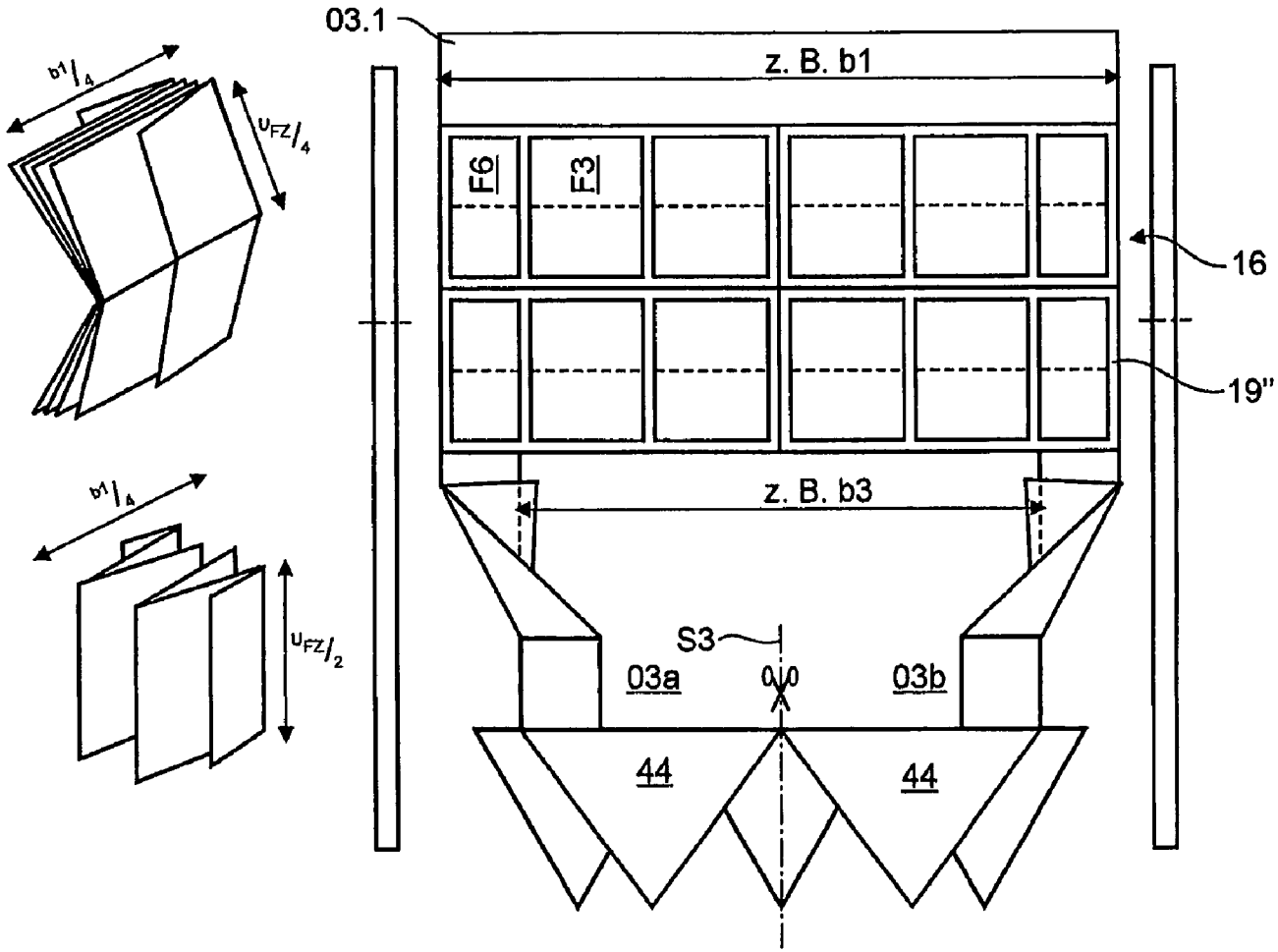
Figure 18:
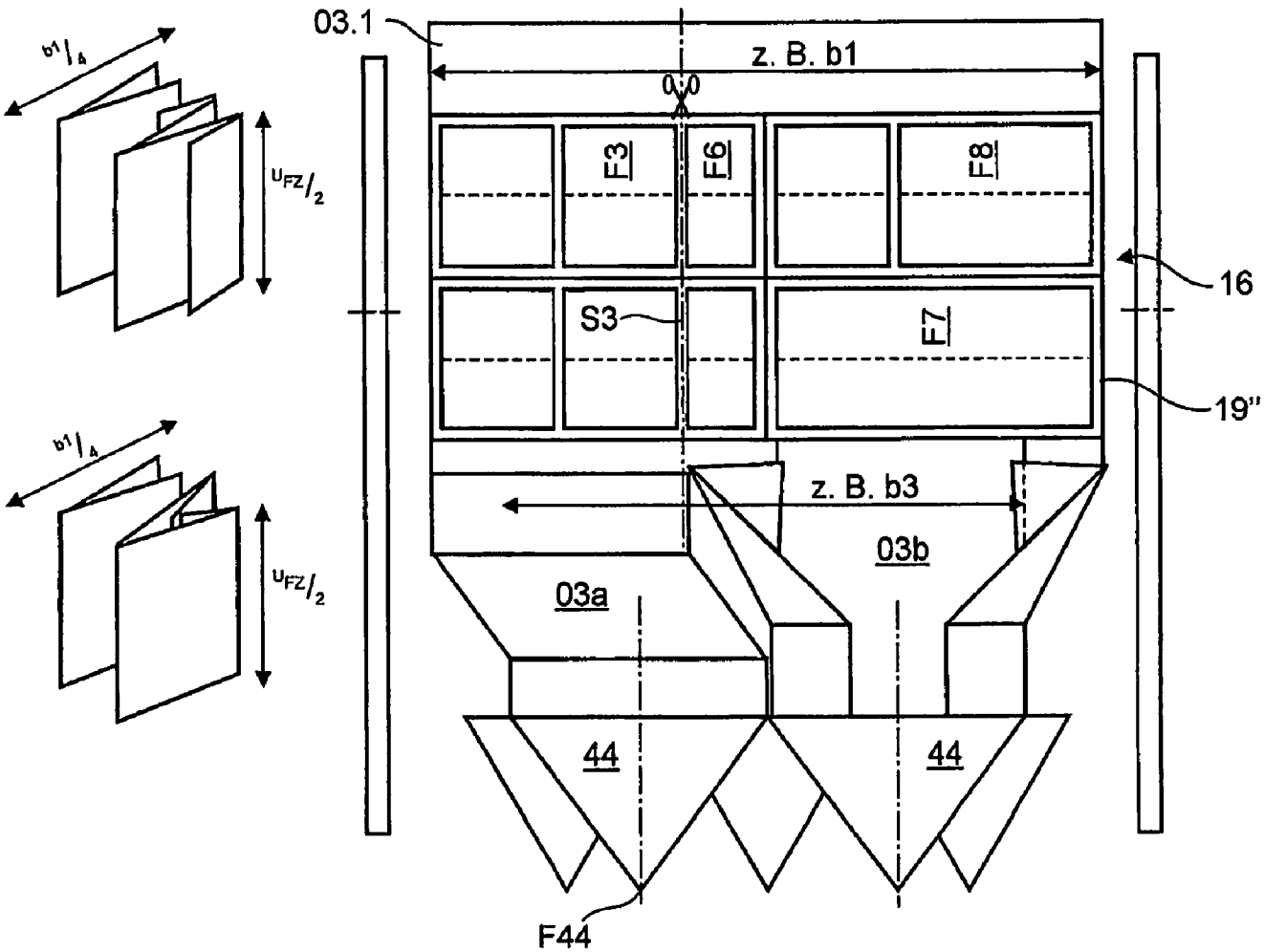

FIGS. 17 and 18 shown two further variations and modes of operation of the printing press in accordance with the present invention. Products can be made in a special format with a plow fold by the use of a web 03, such as, for example, the wider web 03, thereby resulting, in particular, in a tabloid format. Therefore, the forme cylinder 16 is again covered with the printing formes 19" extending over the entire length, which formes have, in the area close to the front, respectively one narrow print image, or format F6 and, in the center area in accordance with FIG. 13 or 15, have print images in tabloid format, for example the above mentioned format F3, in their orientation. The edge areas with the narrow printed pages, in format F6, are respectively folded over in what follows by a plow folding device, which is not specifically represented, before the now folded narrower web 03.2 or 03.3, for example originally the web 03.1 or 03.2 of a width b1 or b2, is longitudinally cut, for example along the main cutting line S3 of the tabloid format. The two partial webs 03*a*, 03*b*, which are already folded in the edge areas, are now either conducted in the manner of the partial webs 03*a* and 03*b* in FIG. 13 to a common former 44, not represented or, as represented in FIG. 17, are conducted straight ahead to the group of two added formers 44. Regarding the configuration of the former 44, what has been said above also applies here.

FIG. 18 represents a further variation of the present invention, with regard to the variety of use of the printing press. The forme cylinder 16 has again been covered, over its entire length, with the two panorama printing formes 19". The cutting line generating the two partial webs 03*a*, 03*b* along the main cutting line S3 for the two added formers 44, however, does not lie in the printing press center axis M, but instead is positioned asymmetrically with regard to the forme cylinder 16 and the imprinted web 03.1. For example, on the one side of the forme cylinder 16, there is a coverage from the outside to the inside with two pages in tabloid format F3 and one printed page in the narrower format F6. Here, the longitudinal cut for forming the two partial webs 03*a*, 03*b* takes place between the inner one of the tabloid printed pages and the narrower printed page of format F6, and thus not in alignment with the printing press center axis M, and also not on the imprinted web 03 in the area of the joint of the two dressings 21 of the transfer cylinder 17. This partial web 03*a* is now conducted onto one of the two formers 44. As represented in FIG. 18, this takes place in one embodiment by laterally offsetting the partial web 03*a* by the use of two turning bars, not represented, in such a way that either the not imprinted area, which is located between tabloid printed pages, or the center of the partial web, are brought into alignment with the folding level F44. In a second embodiment, which is also not specifically represented, at least the respective former 44 is constructed to be movable transversely with respect to the web running direction and has been positioned in such a way that this partial web 03*a* can be conducted straight to it. The remaining partial web 03*b* contains, in addition to the print images of the right printing formes 19", also the narrower print images, format F6 of the left printing formes 19" and receives a plow fold, at least because of the joint of the two dressings 21 of the transfer cylinder 17, prior to being conducted to the other one of the two formers 44, in particular in a straight line. The second partial web 03*b* preferably is also provided with a plow fold in an area of that web 03*b* which is located on the outside. In the example, print images are represented in further special formats F7, F8, which can be selectively arranged together or individually on the previously mentioned printing formes 19". The one special format F8 has a continuous print image of a length of two tabloid printed pages, and the other special format F7 even has a print image of a length of three tabloid printed pages.

Therefore, as represented, in at least one of the modes of operation, the former cylinder 16 of the printing group 13 has a printing forme 19" extending over at least three widths of newspaper pages. As explained above, in one of the modes of operation, the forme cylinder 16 has two printing formes 19" positioned axially side-by-side and each extending respectively over three widths of a newspaper page, of the actually pertinent format F1, F2. In another mode of operation, the forme cylinder 16 of the printing group 13 has several printing formes 19 arranged side-by-side in the axial direction, and each respectively extending over the width of one newspaper page of the actually pertinent format F1.

In the mode of operation for imprinting the larger format F1, it is also possible to arrange triple-wide printing formes 19" on the former cylinder 16, which formes 19" have then also been provided, in particular illustrated, with the print images of three newspaper pages of the larger format F1.

In at least one of the modes of operation, the forme cylinder 16 can have, located side-by-side in the axial direction, printing formes 19', 19" of the actually pertinent format F1, F2, and extending over the width of two newspaper pages.

In the represented embodiment, the forme cylinder 16 has a circumference of two printed pages, arranged one behind the other, of the larger newspaper format F1 and is covered in the circumferential direction with two printing formes 19, 19', 19", arranged one behind the other. The ends of the printing formes 19, 19', 19", which are axially aligned one behind the other, are preferably arranged on the forme cylinder 16 in continuous groove openings 28. Preferably, the printing formes 19, 19', 19" are then arranged in two groove openings 28, or grooves 27, which are offset with respect to each other, by 180° in the circumferential direction and which are continuous in the axial direction.

Figure 19:
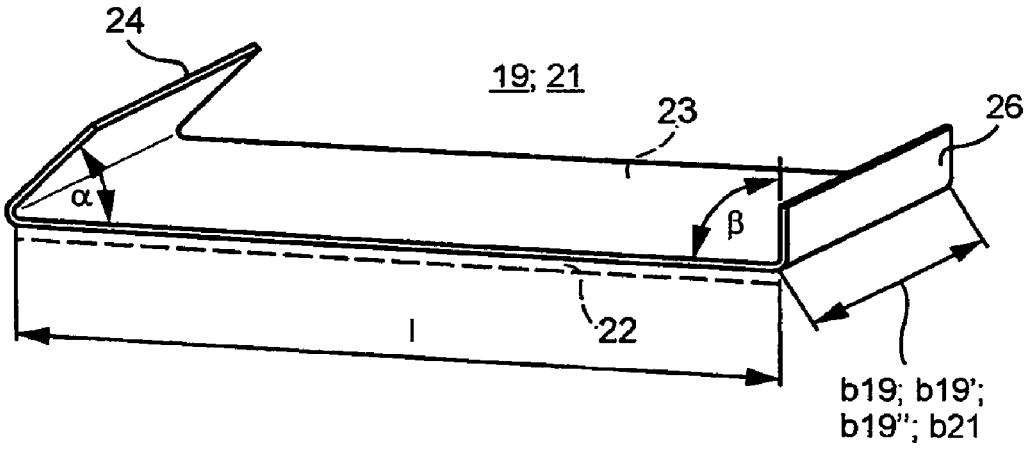

The width b21 of each of the blankets 21, as seen in FIG. 19 corresponds, for example, in both modes of operation to the previously mentioned number, specifically three in this case, of printed pages of the larger format F1. As represented, for example in FIG. 4, the ends of the two blankets 21 are fastened, for example, in the two groove openings 38, 39 on the circumference of the transfer cylinder 17, which openings are offset in the circumferential direction, and in particular by 180° with respect to each other. In the embodiment shown, the two groove openings 38, 39 each substantially extend over the width of the blanket 21, and not over the entire length of the transfer cylinder 17.

In another embodiment, the two groove openings 38, 39 respectively extend over a width corresponding to both blankets 21.

The width b21 of the triple-wide blanket 21 lies, for example, between 900 and 1,250 mm, in particular between 950 to 1,200 mm, and preferably between 1,000 and 1,100 mm.

A width b19" of the triple-wide printing forme 19" also lies, for example, between 900 and 1,250 mm, in particular between 950 to 1,200 mm, and preferably lies between 1,000 and 1,100 mm.

In a not represented embodiment of the present invention, the two blankets 21, which are arranged next to each other, are arranged axially aligned with respect to each other on the transfer cylinder 17 with their ends in a single groove opening 38, which is continuously extending over the length of the transfer cylinder 17.

The groove opening 28, or 38, 39, for receiving the ends of the printing forme and/or for receiving the blanket ends, in the area of the shell face, preferably has a width in the circumferential direction of at most 5 mm, and in particular, at most of 3 mm.

As schematically represented in FIG. 19, the dressings 19, 21 on the forme cylinder and on the transfer cylinder 16, 17 of the printing group 13 are structured as flexible plates, while the dressing 21, which is embodied as a blanket 21, preferably is embodied with multi-layered blankets 21, such as, for example, as a so-called metal blanket 21, having an elastic and/or compressible layer 22, shown in dashed lines arranged on a dimensionally stable support plate 23, such as, for example, a metal plate. The reference numerals relating solely to the metal blanket 21 are attached by dashed lines in FIG. 19. As a rule, a plate-shaped printing forme 19, or a support plate 23 for a rubber blanket consists of a bendable, but otherwise dimensionally stable material, for example an aluminum alloy. It has two oppositely located ends 24, 26, which are to be fastened on or in the cylinder 16, 17 and which are of a material thickness of, for example, 0.2 mm to 0.4 mm, preferably 0.3 mm wherein, for being configured as suspension legs 24, 26, these ends 24, 26 are each beveled or angled along a bending line, in relation to the extended length l of the dressing 19, 21, at an angle $\alpha$, $\beta$ between 40° and 140°, preferably 45°, 90° or 135°, as seen in FIG. 19. For example, a leading edge 24 is beveled or angled at an acute angle $\alpha$ of between 40° and 50°, in particular 45°, and a trailing end 26 is beveled or angled at an angle $\beta$ between 80° and 100°, in particular 90°. If only a single dressing 21 is applied in the circumferential direction of the cylinder 16, 17, and in particular of the transfer cylinder 17, the length l of the dressing 21 almost corresponds to the circumference of this cylinder 17.

In principle, the beveled ends 24, 26 of the dressings 19, 21 can now each be inserted into a slit-shaped opening 28, 38, 29 on the circumference of the respective cylinder 16, 17, which opening is axis-parallel in the longitudinal direction. The ends are held, for example by their shape, by friction or by deformation. However, they can also be additionally fixed in place by a spring force, by pressure or by devices which can be operated by centrifugal force during the operation. In an advantageous embodiment the slit-shaped openings 28 for printing plates 19, which are arranged side-by-side in the axial direction on the forme cylinder 16, are each arranged aligned, for example as a continuous slit-shaped opening 28, while the openings 38, 39 for the two rubber blankets 21, which are arranged side-by-side on the transfer cylinder 17, are not continuous, but are offset with respect to each other by 180° in the circumferential direction.

What is described in what follows in regard to the dressing ends 24, 26 and the holding device 29, 31 in the groove of the forme cylinder 16 substantially also applies in an advantageous embodiment to the groove 36, 37 of the transfer cylinder 17. Therefore, the corresponding reference numerals have also been indicated for the transfer cylinder 17 in parentheses in FIG. 20.

Figure 20:
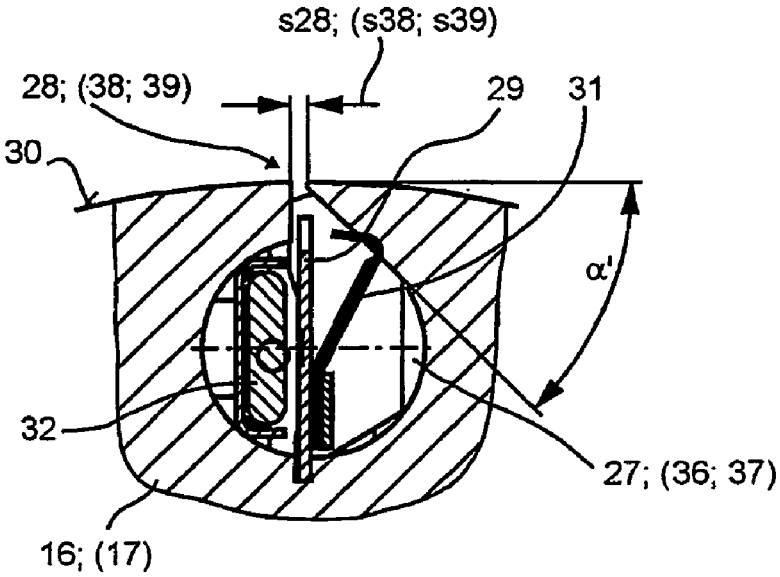

In an advantageous embodiment of the forme cylinder 16, two grooves 27 are provided in the forme cylinder 16. Both grooves 27 extend continuously in the axial direction of the cylinder 16 at least over the entire length of the six sections A to F in the barrel, as seen in FIG. 3. They are arranged, for example offset by 180° from each other, in the circumferential direction of the cylinder 16. Grooves 27, or 36, 37, are arranged underneath a shell face 30 in the interior of the cylinder 16 or 17, which grooves are embodied, as represented in FIG. 20, for example, in the form of circular bores, and which have a narrow slit-shaped opening 28, 38, 39 toward the shell face 30 of the cylinder 16, 17 and extending at least over the length of the six sections A to F. A slit width s28, s38, s39, of the opening 28, 38, 39 on the forme cylinder 16, 17 in the circumferential direction is less than 5 mm, and preferably lies in the range between 1 mm to 3 mm.

The beveled ends 24, 26 of the printing forme 19, 21 can now each be inserted into one of the openings 28, 38, 39, which openings extend axis-parallel on the circumference in the longitudinal direction, and can be fixed in place, at least in connection with the trailing end 26, by a holding device 29, 31 arranged in the groove 27 (36, 37).

Here, the holding device 29, 31 has at least one clamping piece 29, for example a clamping element 29, and a spring element 31, as seen in FIG. 20. The trailing suspension leg 26, which is not represented, and which is beveled at right angles, as seen in FIG. 19, preferably comes into contact with a wall of the opening 28 38, 39, which wall is substantially formed complementary to the bevel, and is there pressed by the clamping piece 29 by the use of a force exerted on the clamping piece 29 by the spring element 31. The non-represented, acutely-angled leading suspension leg 24, as seen in FIG. 19, preferably comes into contact with a wall of the opening 28 38, 39, which wall is substantially formed complementary to the bevel and which wall, together with the shell face 30, forms a suspension edge, or protrusion, at an acute angle $\alpha'$ of 40° to 50°, and in particular of 45°. To release the clamping of the trailing end 26, an actuating assembly 32 is provided in the groove 27 36, 37 which, assembly 32, when operated, acts counter to the force exerted by the spring element 31 on the clamping piece 29 and pivots the clamping piece 29 away from the wall, or the end 26.

In an advantageous embodiment, not only is one clamping piece 29 arranged in the groove 27 of the forme cylinder 16. Instead, several clamping pieces 29 are arranged situated axially side-by-side and extending over the length of the sections A to F in the manner of segments, each with at least one spring element 31. For example, several, such as, for example, six such clamping pieces 29 are arranged for each section A to F. Centered between the clamping elements 29 of each section A to F, and in this case between the third and fourth clamping element 29 of each section A to F, respectively one having a register block can be arranged. The register block, or indexing pin, can be manually displaced in the axial direction, for example in the groove of a base. In a non-represented further development, the register block can also be respectively axially movable by the operation of an actuating device, which actuating device is axially guided in the unoccupied hollow space of the groove 27, or by the operation of an indexing element, such as, for example, a threaded spindle, which can be driven by a motor.

In the embodiment represented, the actuating assemblies 32 for the forme cylinder 16 are configured in such a way that, when they are operated, the holding devices 29, 31, such as all of the clamping pieces 29, are simultaneously locked or are opened over the length of the sections A to F. In the case of the transfer cylinder 17, this applies to the holding device, or devices 29, 31 of the respective area ABC or DEF. In this case, the actuating assemblies 32 for the forme cylinder 16 are configured as a reversibly deformable hollow body 32, such as, for example, a hose 32, which hose can be charged with a pressure medium and which respectively extends over at least the length of the sections A to F, and for use with the transfer cylinder 17, as such a hollow body respectively extending at least over the sections ABZ or DEF, which runs in the groove 27, 36, 37. In accordance with FIG. 20, this hose 32 is arranged in the groove 27 to work together with the clamping pieces 29 in such a way that, when it is actuated, it counteracts the spring elements 31, which close the holding device 29, 31 in a self-locking manner. It is then conducted through the areas of possibly provided indexing elements.

In an embodiment which is advantageous, in particular, in connection with the printing units 02 of six pages width, or cylinders 16, 17, a device for pressing a dressing 19, 21 against a cylinder 16, 17, and in particular for pressing a printing forme 19 against the forme cylinder 16, referred to as a pressing device in what follows, is respectively assigned to at least two cylinders 16, 17, and in particular is assigned to two forme cylinders 16 of at least one of the printing towers 01. For example, this is advantageous if it is intended to perform a rapid, such as, for example, a flying, plate change in two corresponding printing groups 13. It is advantageous if such a pressing device is assigned to all of the forme cylinders 16 of a printing tower 01, in particular for use in accomplishing a rapid, dependable and exact product change. An appropriate pressing device has, for example, at least six pressing elements, such as, for example, six roller elements which, selectively for each section A to F, can be individually placed against or away from the dressings 19, 21. A controlled and guided draw-in or mounting, and/or release or removal of the dressing, is made possible. It is also possible, by use of this pressing device, to move an end 24, 26 of the dressing 19, 21 into the appropriate groove 27, 36, 37, or opening 28, 38, 39, or to maintain a released end 24, 26, or the partially released dressing 19, 21, in the desired position. The pressing device extends along the cylinder 16, 17, at least over the entire area of the sections A to F, or in the area of the barrel of the cylinder which is effective for printing. In this way, dressings 19, which is resting on the shell face 30 of the cylinder 16, can be fixed in place as needed by the use of respectively one pressing element, while an end 24, 26 of a dressing 19, or of several dressings 19, is or are released, or is or are not in contact with the cylinder.

The above described embodiment of the pressing device is advantageous, in particular, in connection with the embodiment of the common actuating device extending over all of the sections A to F, as described in FIG. 20. In this constellation, the individual or the grouped mounting, changing and/or removal of six printing formes 19, arranged side-by-side on the forme cylinder 16, is also possible, without an increased outlay for actuating assemblies or operating medium supply being required within the forme cylinder 16. Manufacture, mounting and maintenance is considerably reduced by the provision of this actuating device.

In an advantageous embodiment of the present invention, the cylinders 16, 17, 18 of the printing unit 02 are driven in such a way that the printing groups 13 of the printing unit 02 can each be rotatorily driven at least by a drive motor which is mechanically independent of the remaining printing groups 13, both during set-up operations as well as during a production run. In the case of the satellite printing unit 02, the satellite cylinder, or cylinders can also be rotatorily driven by a drive motor mechanically independent of the assigned printing groups 13. These drive motors are preferably configured as electric motors, whose angular position is regulated, and may be configured for example as asynchronous motors, synchronous motors or as d.c. motors. In an advantageous further development, at least one gear, and in particular at least one reduction gear, such as, for example, a pinion gear, an attachment gear and/or a planetary gear is arranged between the respective drive motor and the cylinder 16, 17, 18, or cylinder pair 16, 17, 18 to be driven.

Figure 23:
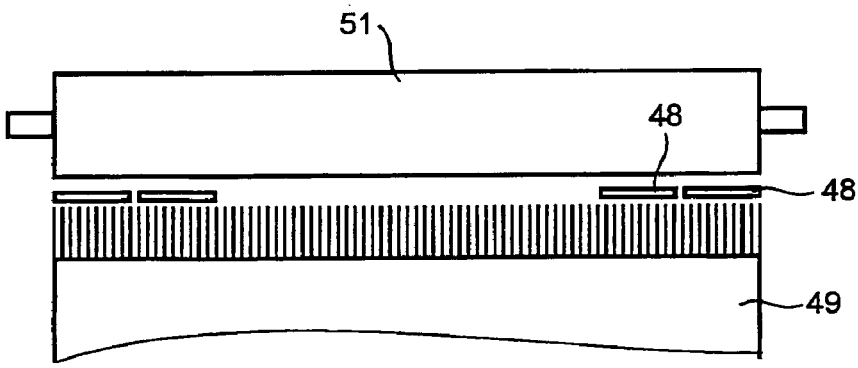

In a particularly advantageous manner, the dampening unit 20, which in particular, is in the form of a spray dampening unit 20, has closing elements 48, or so-called "shutters", in the edge areas of the possible transfer width, which shutters can be selectively introduced into the spray path, in the case of a narrower web 03.2, 03.3. At least one such closing element 48 is provided for each edge area, which substantially corresponds to a width of half the difference between the smaller and the larger width b1, b2, b3 of the web 03.1, 03.2, 03.3 which is intended to be imprinted. FIG. 23 schematically shows the circumstances, in which respectively two of such closing elements 48 for each edge area, are provided between a spray source 49 and a roller 51 of the dampening unit 20, which then together have a width for each edge area, of half the difference between the smaller and the larger width b1, b2, b3 of the web 03.1, 03.2, 03.3 which is intended to be imprinted. Advantageously, the spray source 49 can be embodied as a spray arm 49 with spray nozzles, or as a brush roller 49. However, other embodiments of the spray source are also conceivable, at least in principle.

Depending on the type of operation, or on the web 03.1, 03.2, 03.3 to be imprinted, non-represented color meters of color zones in the inking unit 14 are selectively either principally closed or are released for the image-related control of the amount of ink.

As previously shown in FIG. 4 and the following drawings, and as already described above, in addition to the represented special embodiment and equipping of the forme and transfer cylinders 16, 17, or the layout of the printing group 13, the arrangement and the embodiment of the group of at least three side-by-side arranged formers 41, 42, 43 as guide and/or processing elements 41, 42, 43 in the folding structure 11, plays an important role in the layout of the printing press for different product formats. As symbolized in FIG. 4, by the two-headed arrows in the formers 41 and 43, in an advantageous embodiment, the two outer formers 41, 43 of the three formers 41, 42, 43, which are arranged side-by-side on a common level, are arranged to be movable transversely with respect to the inflow direction of the partial webs 03*a*, 03*b*, 03*c*. The center former 42 can be arranged stationary. Its former tip is preferably located in the printing press center axis M. Here, by depicting three formers 41, 42, 43 arranged side-by-side on a common level, it should be understood that the formers 41, 42, 43 of this group are arranged side-by-side transversely to the running direction of the incoming webs, or the partial webs 03*a*, 03*b*, 03*c*, and offset with respect to each other and, viewed in a horizontal plane, overlap each other at least partially.

Figure 21:
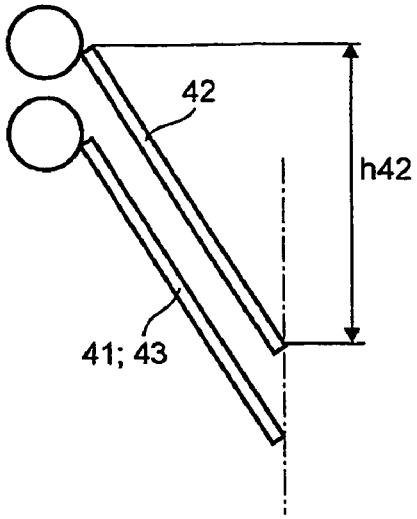

In a first structural variation, which is schematically shown in FIG. 21, the two outer formers 41, 43 are slightly offset in the vertical direction, in comparison with the center one, but when viewed in the horizontal plane, are overlapping the center former 42 so that, when required, as in the case of a narrow web 03.2 and correspondingly narrow partial webs 03*a*, 03*b*, 03*c*, their edge sections close to the center former 42 can be brought into congruence with the center one, as viewed from above. However, the tips of the formers are vertically aligned with each other, as shown in dash-dotted lines, so that folded continuous webs come to rest on top of each other. The vertical offset is maximally half the height h42 of the former.

Figure 22:
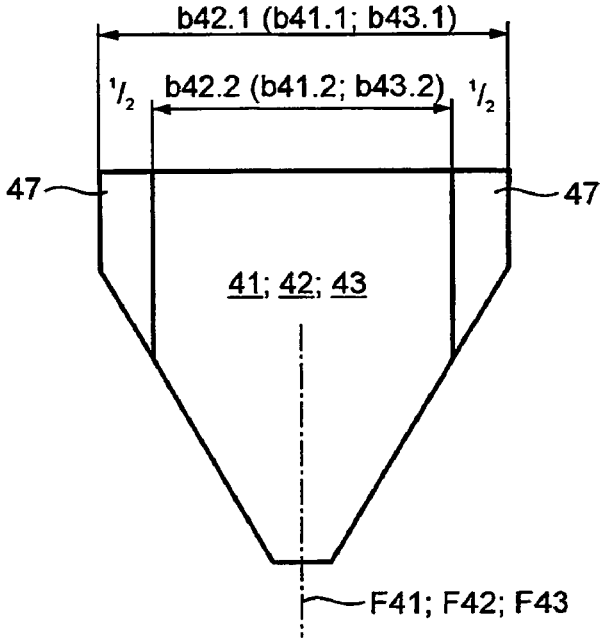

In a second variation, which is schematically shown in FIG. 22, the formers 41, 42, 43 have movable, such as, for example, tilt-away or removable attachment elements 47 in the respective edge areas. In the case of the wide web 03.1 and of correspondingly wider partial webs, these attachment elements 47 are in an operating position and, in the case of the narrower web 03.2 and correspondingly narrower partial webs, these attachment elements 47 are removed from the active area. The attachment elements 47 widen the transport level of the respective former 41, 42, 43, which is that level of each former which is formed by the contact zones of the converging flanks with the web 03. In the first mentioned operating position, at least the center one 42 of the formers has a width b42.1, while in the second operating position it has a width b42.2. Thus, in the second operating position, the effective width is embodied to be narrower by a total amount Δ. The same can correspondingly apply in connection with the two outer formers 41, 43. However, the two outer formers 41, 43 can also be configured so that they can be narrowed by the amount Δ/2 only on the side of each outer former which is facing the center former 42. In FIG. 13, the width b41, b42, b43 of the formers 41, 42, 43 has been shown, by way of example without the attachment.

A possible result of a movement of the outer formers 41, 43 is represented in FIGS. 5*a* and 5*b*, wherein they are represented spaced either farther apart or closer to the center former. In actually, however, the width of the formers 41, 42, 43 practically never falls below that of the partial webs 03*a*, 03*b*, 03*c*, and should only be understood as being symbolic in the drawing figures.

The fixed width intended for newspaper printing with a fixed format or, in the case of variable newspaper printing, the non-reduced width B42.1 of at least the center former, but possibly of all three of formers 41, 42, 43, lies, for example, between 600 and 830 mm, advantageously lies between 630 and 800 mm, and in particular lies between 630 to 730 mm. With formers 41, 42, 43 of variable width, the width B42.2 of at least the center former, but possibly of all three formers 41, 42, 43 lies between approximately 580 to approximately 700, advantageously lies between 580 to 680 mm, and preferably lies between approximately 616 mm and 650 mm. In connection with variable formers 41, 42, 43, a selectable difference Δ lies, for example, between 100 and 250 mm, and in particular lies between 120 to 200 mm. The widths are selected from the above recited value ranges to correspond to each other. Correspondingly, half the value applies to Δ/2.

The effective width b44, which is the maximum width in the upper former area of the added former 44 is preferably significantly greater than that of the non-reduced formers 41, 42, 43 of the former group. For example, the width of the added former should be greater, by a factor of 1.05 to 1.4, and in particular by 1.1 to 1.3, than an unchangeable one, or the maximum width b41.1, b42.1, b43.1 of the formers 41, 42, 43 of the former group.

In a variation, shown for example, in accordance with FIG. 15, both of the added formers 44 can be embodied with a variable width b44, in which case the above-mentioned ratios relate to the maximum width b44 of the added former 44.

In an advantageous embodiment, the variable printing press has one or several of the subsequently described guide and/or processing elements on the path of the web 03.1, 03.2, 03.3 through the printing press.

Figure 24:
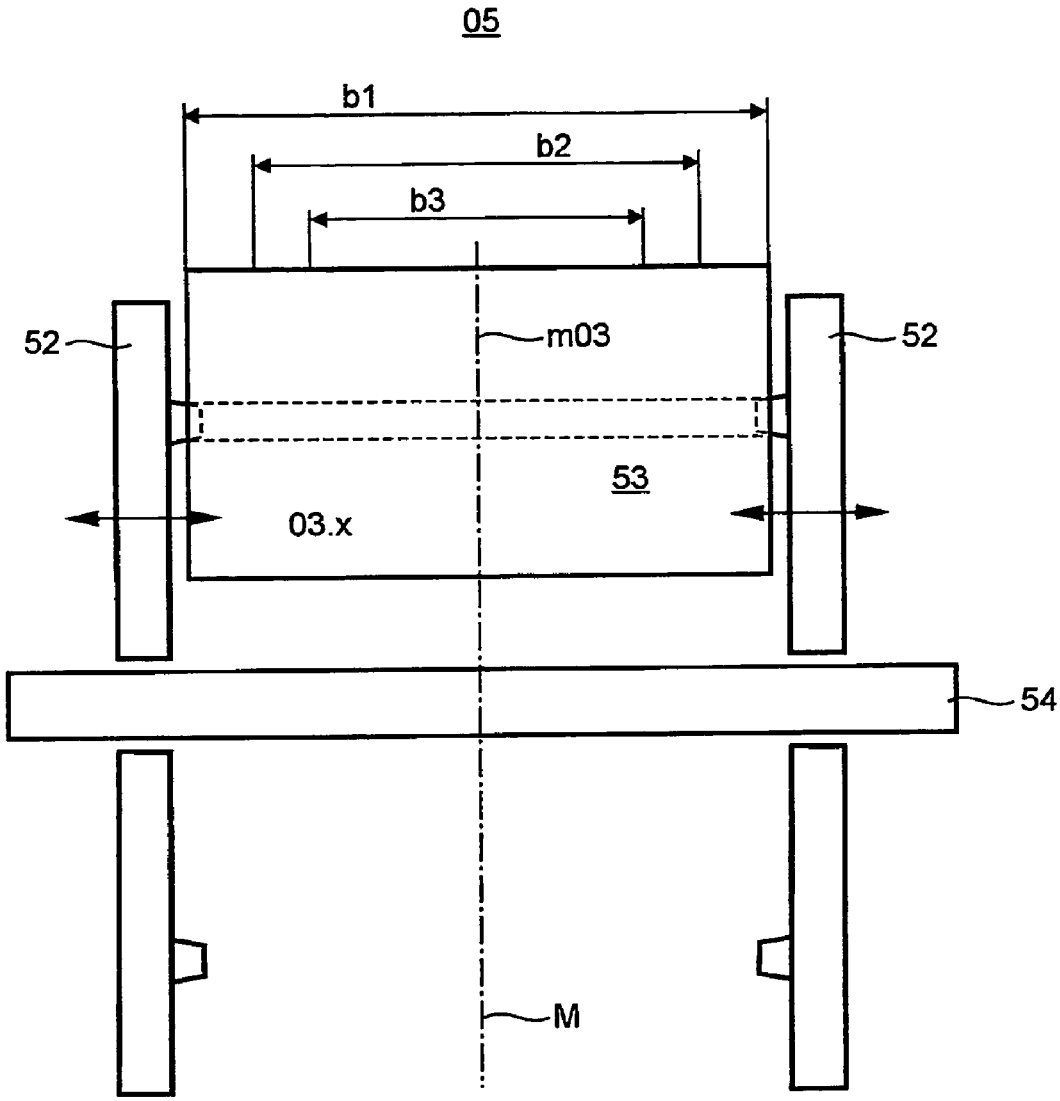

In an advantageous embodiment of the roll changer 05, shown in FIGS. 1 and 24, it is provided that support arms 52 are movably seated on a pivot shaft 54, with respect to each end of a roll 53 to be unwound, and in such a way transversely to the printing press center axis M, that, independently of the width b1, b2, b3 of the actually used web 03.1, 03.2, 03.3, the roll 53 can be positioned in such a way that the center level m03 of the roll 53 on the shaft coincides with the printing press center axis M. The support arms 52, which here act as guide elements and/or as processing elements 52, can be positioned symmetrically and in opposite directions, with respect to the printing press center axis M.

In the representation of guide and/or processing elements described in what follows, the same reference numerals have been used in part, provided the associated parts have the same functionality or configuration. In what follows, cutting, web guidance, web drive and/or web conducting elements, such as, for example, contact rollers, turning bars, longitudinal cutters and/or guide rollers, are understood to be guide and/or processing tools.

Figure 25:
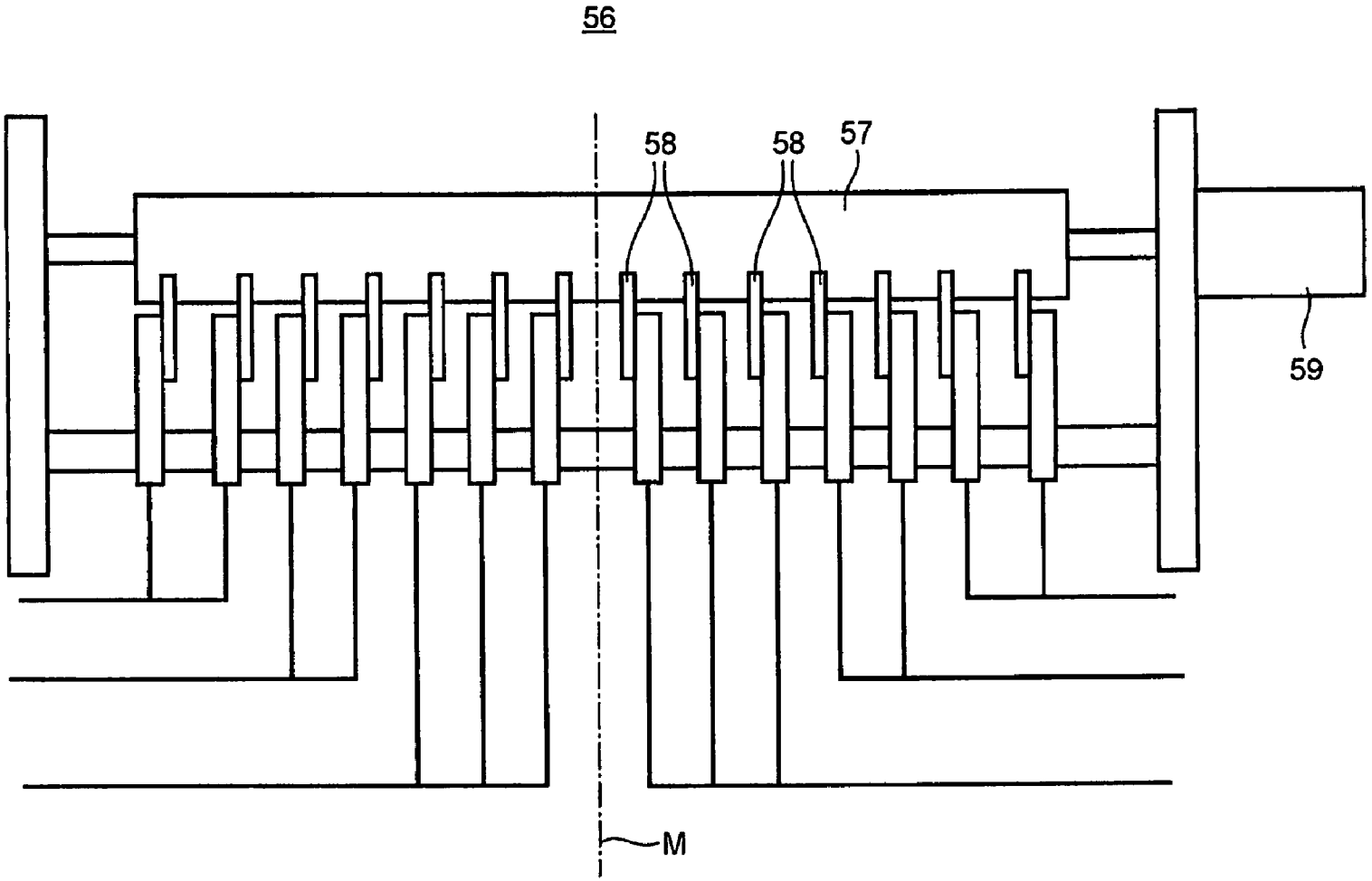

In addition to, or even independently of, the configuration of the other guide and/or processing elements, it is possible to provide a traction group 56, as seen in FIG. 25, and consisting of a traction roller 57 and of a plurality of pressure rollers 58 which can be selectively brought into contact with the latter, such as, for example, rubber rollers, in the draw-in group 10. These have been combined symmetrically with respect to the printing press center axis M into several, and at least two groups and are connected, in groups, for the purpose of being brought into or out of contact. In the example, two groups, of two pressure rollers, and one group of three pressure rollers 58 are provided from the outside toward the inside for each half of the traction roller 57. Contacting, for example, is performed pneumatically from a non-represented source, or electrically. Now, depending on the mode of operation, when imprinting a wide web 03.1, all of the pressure roller groups are placed against the traction roller, and when imprinting a narrower web, the outer pressure roller groups remain out of contact. The traction roller 57 is rotatorily driven by a drive motor 59.

Figure 26:
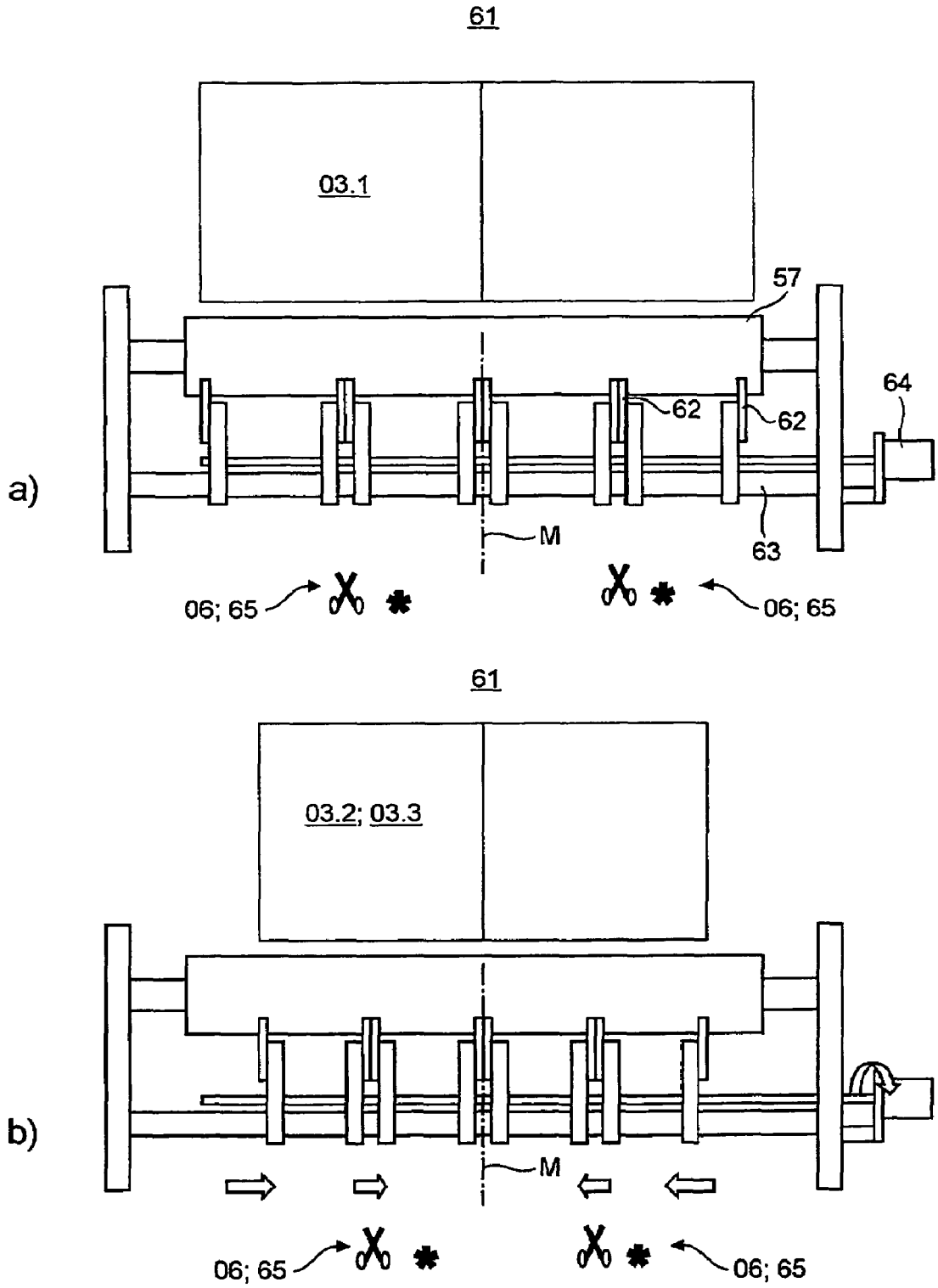

In another embodiment of a traction group 61, such as, for example, one following the last printing unit 02 through which the web 03 passes, or upstream of the former inlet, the traction group 61 has guide and/or processing elements 62, configured as pressure rollers 62, which can be positioned symmetrically and transversely with the printing press center axis M and in the opposite direction to each other, as seen in FIGS. 26*a* and *b*. An uneven number of pressure rollers 62 is preferably provided wherein, for example, the center one is effectively in alignment with the printing press center axis M and is stationary with regard to a direction extending transversely to the transport direction, while all of the out-of-center pressure rollers 62 are embodied to be movable transversely to the transport direction and can therefore be adjusted to the web width. In this case, positioning of the pressure rollers 62 can advantageously take place via at least one threaded spindle 63, which preferably can be driven by a drive motor 64. For the pressure rollers 62 of each one of the two sides of the traction roller 57, it is possible to provide each side their own threaded spindle 63 having several sections of different pitch or, as represented, a common threaded spindle 63 with several, such as here, respectively two left-hand and right-hand threads of different pitch. In the course of imprinting a wide web 03.1, as seen in FIG. 26*a*, the pressure rollers 62, which are provided outside of the printing press center axis M, are located farther out than they would be when being used during the imprinting of a narrower web 03.0, 03.3. Scissors symbols in FIG. 26 are used to indicate a longitudinal cutting device 06, located upstream of the turning devices 07 or 65, located downstream of the turning devices 07, but upstream of the former inlet, which possibly follows the traction group 61.

Figure 27:
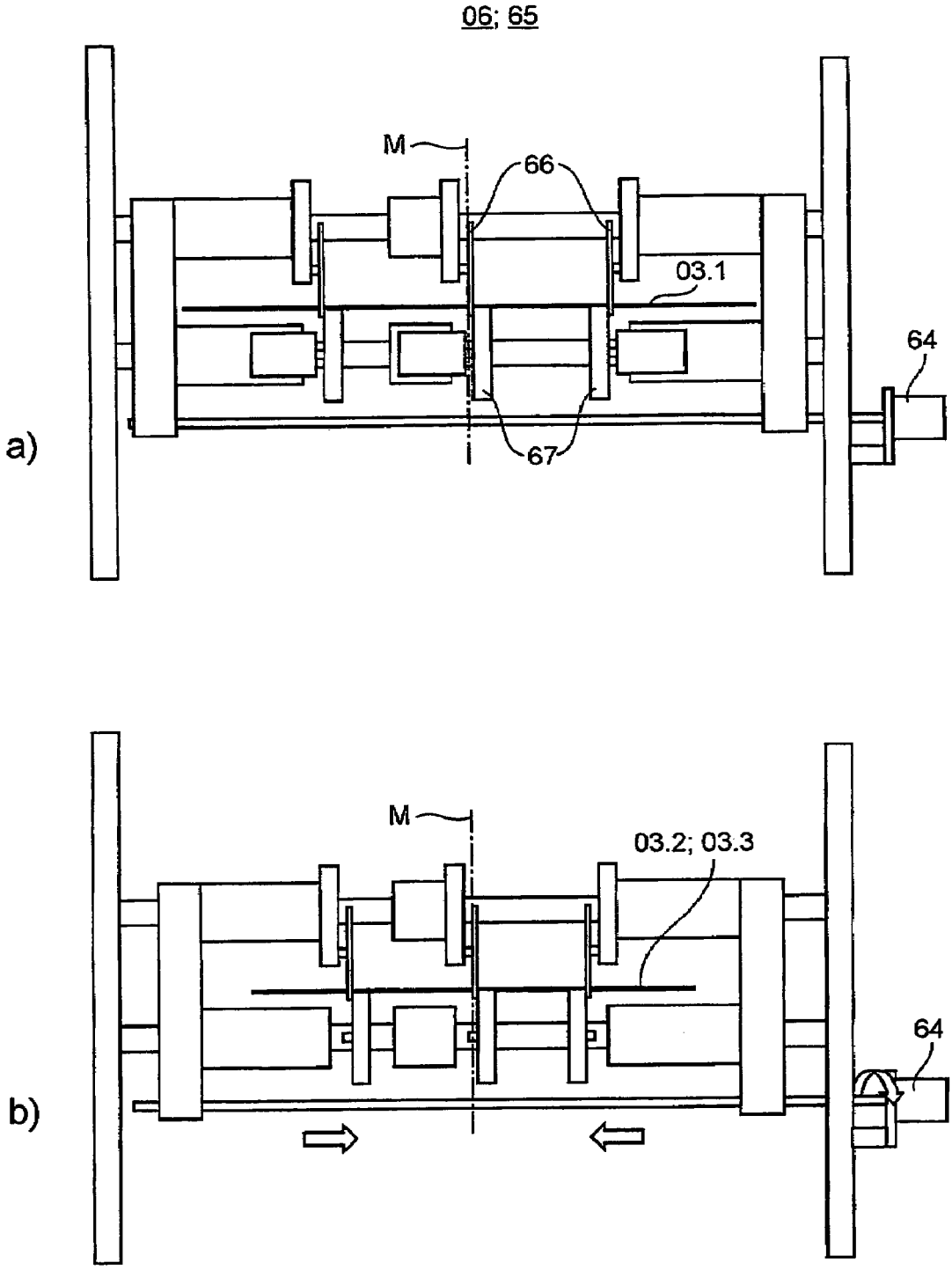

Again, the longitudinal cutting device 06, 65 preferably has an odd number of guide and/or processing elements 66, here embodied as cutters 66, which elements can be positioned symmetrically and transversely with respect to the printing press center axis M, and in the opposite direction to each other. Preferably, the center guide and/or the processing element 66 is again effectively in alignment with the printing press center axis M, and is arranged stationary transversely, with regard to the transport direction, while all of the out-of-center cutters 66 are movable transversely to the transport direction and are therefore embodied so that they are adjustable to the web width. As is shown in FIG. 26, positioning advantageously takes place using the pressure roller 62. Counter-cutters 67 are preferably also positioned together with the cutters 66. In the course of imprinting a wide web 03.1, as shown in FIG. 27*a* the cutters 66 which are provided outside of the printing press center axis M, are located farther outward than during imprinting a narrower web 03.2, 03.3. The center cutter remains stationary, in alignment with the printing press center axis M.

Figure 28:
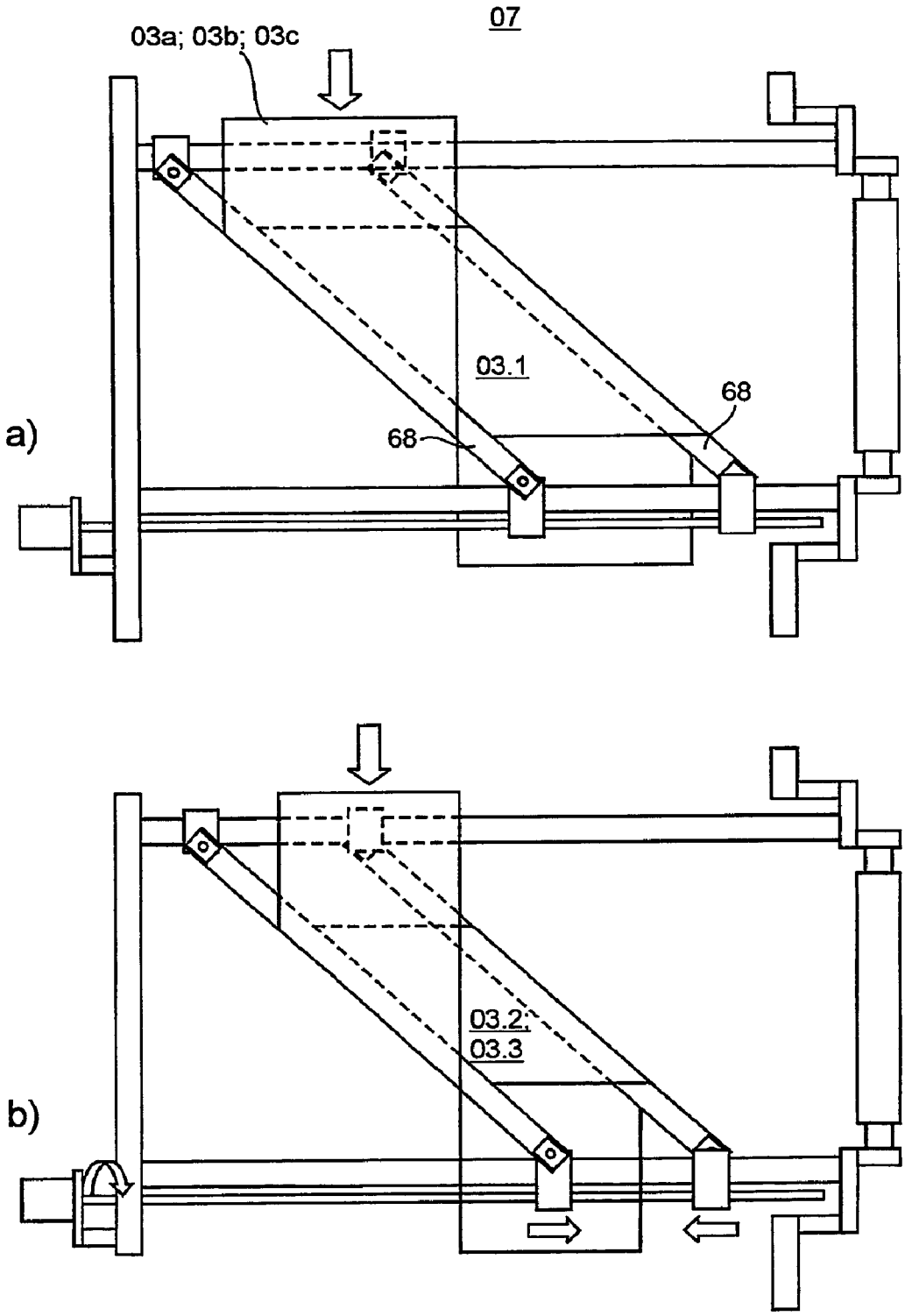
Figure 29:
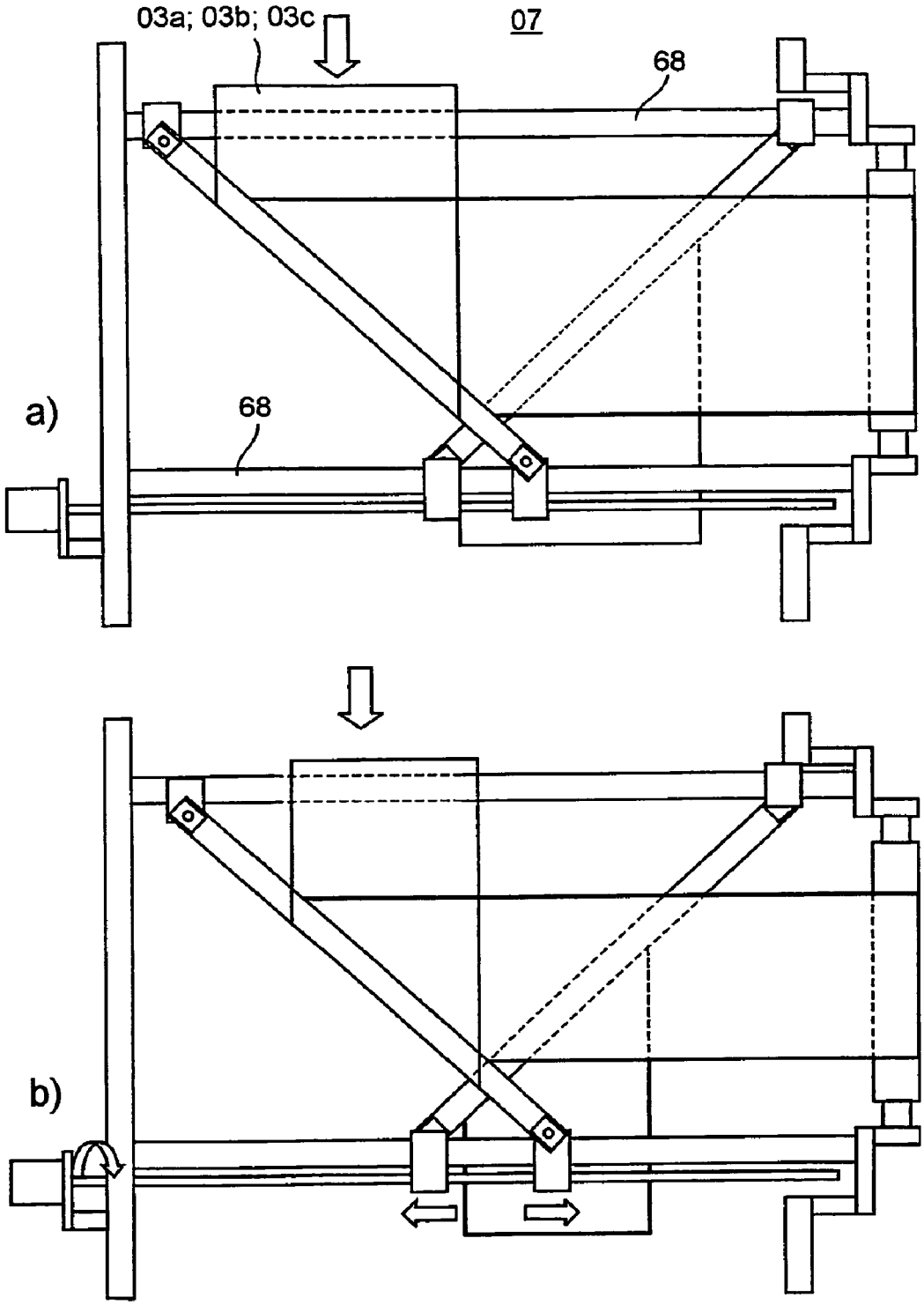

FIGS. 28*a* and *b*, and FIGS. 29*a* and *b*, represent two possible embodiments of a turning bar arrangement 07, in which two guide and/or two processing elements 68, which are embodied as turning bars 68, are arranged to be positioned transversely with respect to an inflow direction of the partial webs 03*a*, 03*b*, 03*c*. FIGS. 28*a* and *b* show parallel turning bars 68, which are inclined 45° to the inflow direction, and which is usable for laterally offsetting a partial web 03*a*, 03*b*, 03*c*. FIGS. 29*a* and *b* show two turning bars 68, which are inclined 45° and 135° to the inflow direction, and which are usable for laterally offsetting and for tipping a partial web 03*a*, 03*b*, 03*c*. Again, positioning advantageously takes place by the use of a threaded spindle, such as is shown in FIG. 26 for the rollers 62. FIG. 28*a* and FIG. 29*a* show the turning bar position in the course of imprinting a wide web 03.1 FIG. 28*b* and FIG. 29*b* show the position of the turning bar in the course of imprinting a narrower web 03.2, 03.3.

Figure 30:
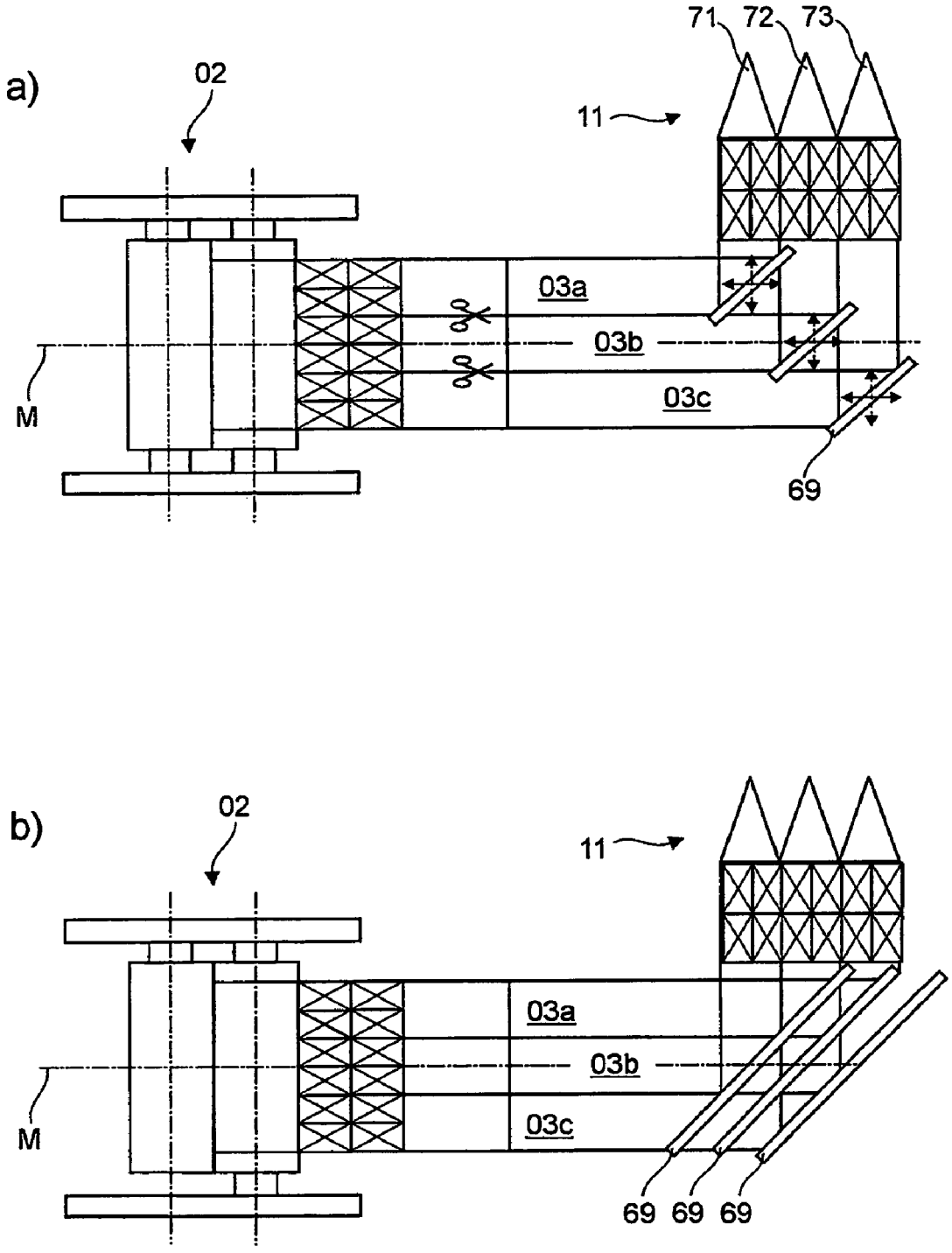
Figure 31:
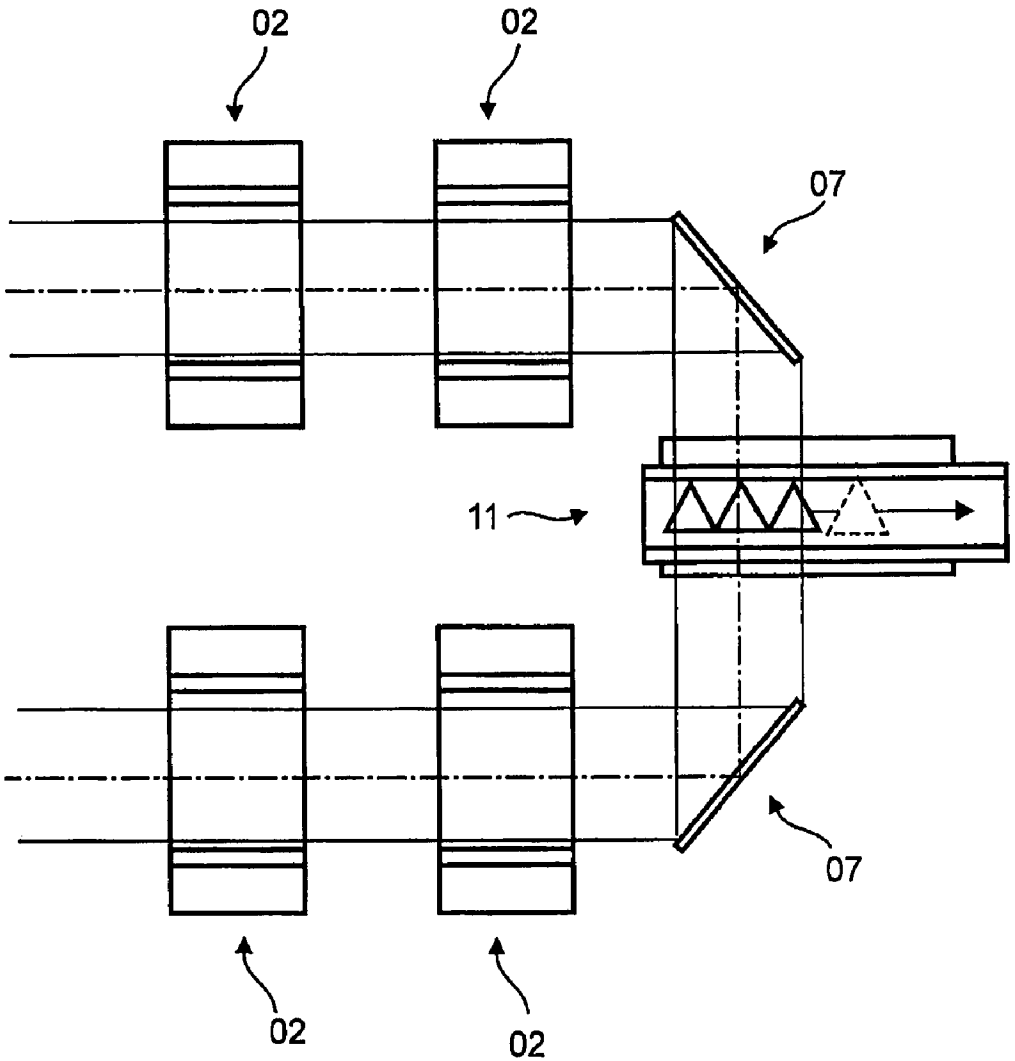

An alternative embodiment of a variable printing press in accordance with the present invention is represented in FIGS. 30*a* and *b*. The webs 03, or the partial webs 03*a*, 03*b*, 03*c* are conducted toward the folding or former structure 11, which are positioned out of alignment, by 90°, with the printing press center axis M. The former structure 11 and the folding apparatus 12, which is not represented in FIG. 30, are offset by 90° with respect to the printing press represented in FIG. 1. If, as indicated by the two-headed arrows in FIG. 30, three movable turning bars 69 are provided for deflection, it is possible, depending on the widths b1, b2, b3 of the webs 03.1, 03.2, 03.3, to find a position of the turning bars 69 so that the partial webs 03*a*, 03*b*, 03*c*, which are generated after longitudinal cutting, can be conducted to three stationary formers 71, 72, 73. In this way, it is possible to employ a former structure 11 with stationary formers 71 to 73, whose fixed widths correspond at least to the width of the partial webs 03*a*, 03*b*, 03*c* that are made from the widest web 03.1. In FIG. 30*a*, turning bars 69 of the width of a partial web, and in FIG. 30*b* turning bars 69 of triple width, or of a width of at least six newspaper pages of the larger format F1 are provided for this use. FIG. 31 schematically shows the arrangement of two printing press sections, each with several, depicted here as two printing towers 01, or printing units 02, by the use of which printing towers 01, production is performed on a common former structure 11 via a turning installation 07 as described in FIG. 30*a* or *b* which, however, is only schematically indicated in FIG. 31.

Figure 32:
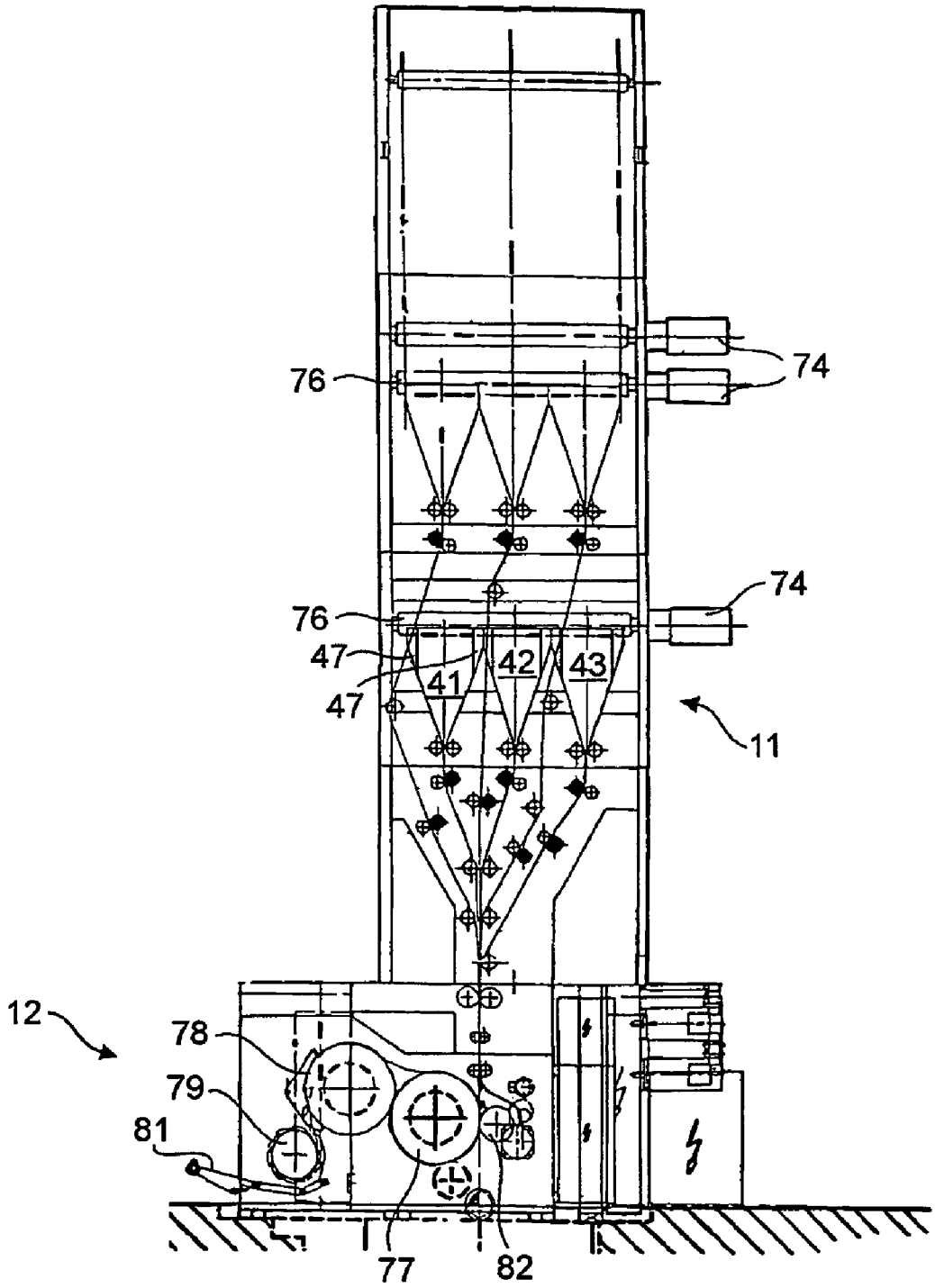

FIG. 32 shows a folding structure 11 in a sectional view. In this way, it is either possible, as represented in FIG. 32, for two groups of substantially identical formers 41, 42, 43 to be arranged on top of each other, and which two groups are either slightly vertically offset, in an arrangement which is not represented, or are configured with attachment elements 47, which are only indicated in connection with lower group. At least one former inlet roller 76, or a traction roller 76, which is driven by a motor 74, is provided directly ahead of each former group.

In an advantageous embodiment, the folding apparatus 12 of the printing press is configured with seven fields in connection with all the above-described preferred embodiments.

The circumference of the transport cylinder 77 corresponds to more than five, and in particular to seven, section lengths or seven lengths of the signature and is thus a "transport cylinder 77 with seven fields". Seven holding devices have been situated, one behind the other, in the circumferential direction of cylinder 77 with equal spacing between each, in the transport cylinder 77. These holding devices can be provided, for example, as spur needle strips with extendible spur needles or as a spur needle folding apparatus. The holding devices can also be embodied as grippers, or as a gripper folding apparatus. Furthermore, seven cutting strips are arranged, each of which, viewed in the direction of rotation, is preferably slightly spaced apart, such as, for example, by 0.3 to 3 cm on the shell face of the transport cylinder 77 with respect to the position of the respective associated clamping point or gripper folding apparatus, or the spur needle penetration point for the spur needle folding apparatus. Preferably, the circumference of the folding jaw cylinder 78 corresponds to more than five, and in particular corresponds to seven section lengths, or to seven lengths of the signature.

Seven folding blades are furthermore attached to the transport cylinder 77 which folding blades, when reaching a gap, either each time, or after multiple times, and whether in connection with collating operation or normal operations between the transport cylinder 77 and a folding jaw cylinder 78, are extended for transferring the signatures conveyed on the transport cylinder 77 to the folding jaw cylinder 78, and to fold them. For this purpose, the folding jaw cylinder 78 has, evenly spaced apart in the circumferential direction, for example, as many folding jaws, which are not represented as the number of folding blades and/or of holding devices on the transport cylinder 77, in this case seven in particular. The folded products are transferred from the folding jaw cylinder 78 to a paddle wheel 79 and are delivered from there to a delivery device 81, such as, for example, a conveyor belt 81.

A cutting cylinder 82, which works together, as a transverse cutting arrangement, with the transport cylinder 77, can be constructed to be a double cutting cylinder, with two cutters on the circumference, and spaced apart by a section length, or also as a quadruple size cylinder, or as one having four cutters on its circumference, each spaced apart by a section length.

The concept of the asymmetrically exposed panorama printing formes, in particular together with at least one of several transversely movable formers 41, 42, 43, can be applied, in addition to a press of a width of six pages, or with six print images side-by-side, also to other presses, and in particular to newspaper printing presses of a width of four pages, with four print images side-by-side. In this case, such as, for example, in connection with a press of a width of six pages, n=3 print images, and in connection with a press of a width of four pages, n=2 print images, printing formes are arranged, in particular, asymmetrically, side-by-side in the axial direction on a printing forme 19". An example of this is provided in FIGS. 33*a* and *b*, wherein in FIG. 33*a* the forme cylinder 16 is covered with print images of the larger format F1. In this case, the four print images can be arranged on eight individual printing formes 19, on four panorama printing formes 19', with respectively two next to, and behind each other, or in combination, as combined in FIG. 33 by way of example. Preferably, the printing formes 19, 19' cover the entire effective length L16, or the width b1, of the larger web 03.1 to be imprinted. If the printing group 13 is not configured with a double circumference, or with two newspaper pages in the circumferential direction, but simply, this also applies to four individual printing formes 19, to two panorama printing forms 19', or to a mixture.

In the other mode of operation, with a narrower web 03.2, the forme cylinder 16 now has print images of the smaller format F2. The printing formes 19" are preferably again configured as panorama printing formes 19", with two printed pages of the smaller format F2, but again still substantially extend over the area of the possible print length of the wider web 03.1. In other words, they have the same width as the panorama printing formes 19" of the larger format F1. As explained above, the printing formes 19" have again been asymmetrically exposed. The same as was the case in the previously-described arrangement with three formers, a former structure is also advantageous here, wherein a distance A1 of the folding levels F42, F43 can be changed in the above mentioned way.

As represented in FIG. 33, for example two printing blankets 21 are arranged side-by-side on the transfer cylinder 17, each of which blankets 21 has a width of two printed pages of a newspaper format F1, F2, and in particular of the larger newspaper format F1. These blankets 21 can then each respectively extend over the full circumference of cylinder 17, and can again be arranged on the transfer cylinder with their ends aligned, or with their ends alternating by 180°.

It is explicitly pointed out that the discussion which follows, which is represented in connection with the printing press shown in accordance with FIG. 34, can be advantageously applied, either considered by itself alone, or also especially taken together with one or with several of the characteristics so far described, such as, for example, the printing blankets 21 of a width of three newspaper pages, and/or the format variability, and/or the described adjustability of one or of several of the guide and/or processing elements 41, 42, 43, 52, 62, 66, and/or the satellite-type construction and/or the arrangement of the groove openings 28, 38, 39, and/or the width of the groove openings 28, 38, 39, and/or the special arrangement of formers 41, 42, 43, 44, and/or of other characteristics not specifically mentioned in this listing. The same applies for the contents of FIGS. 35 and 36.

Figure 35:
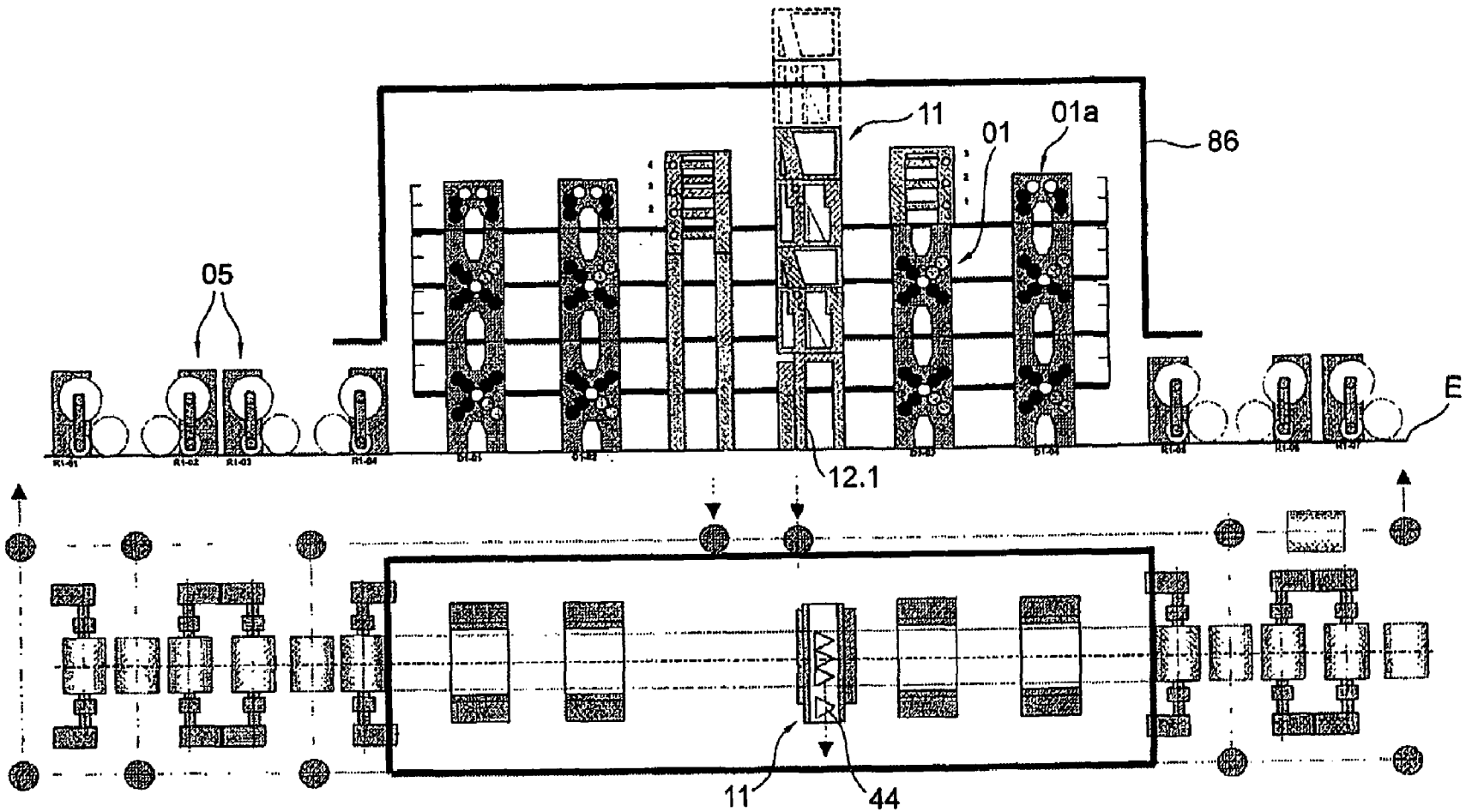
Figure 36:
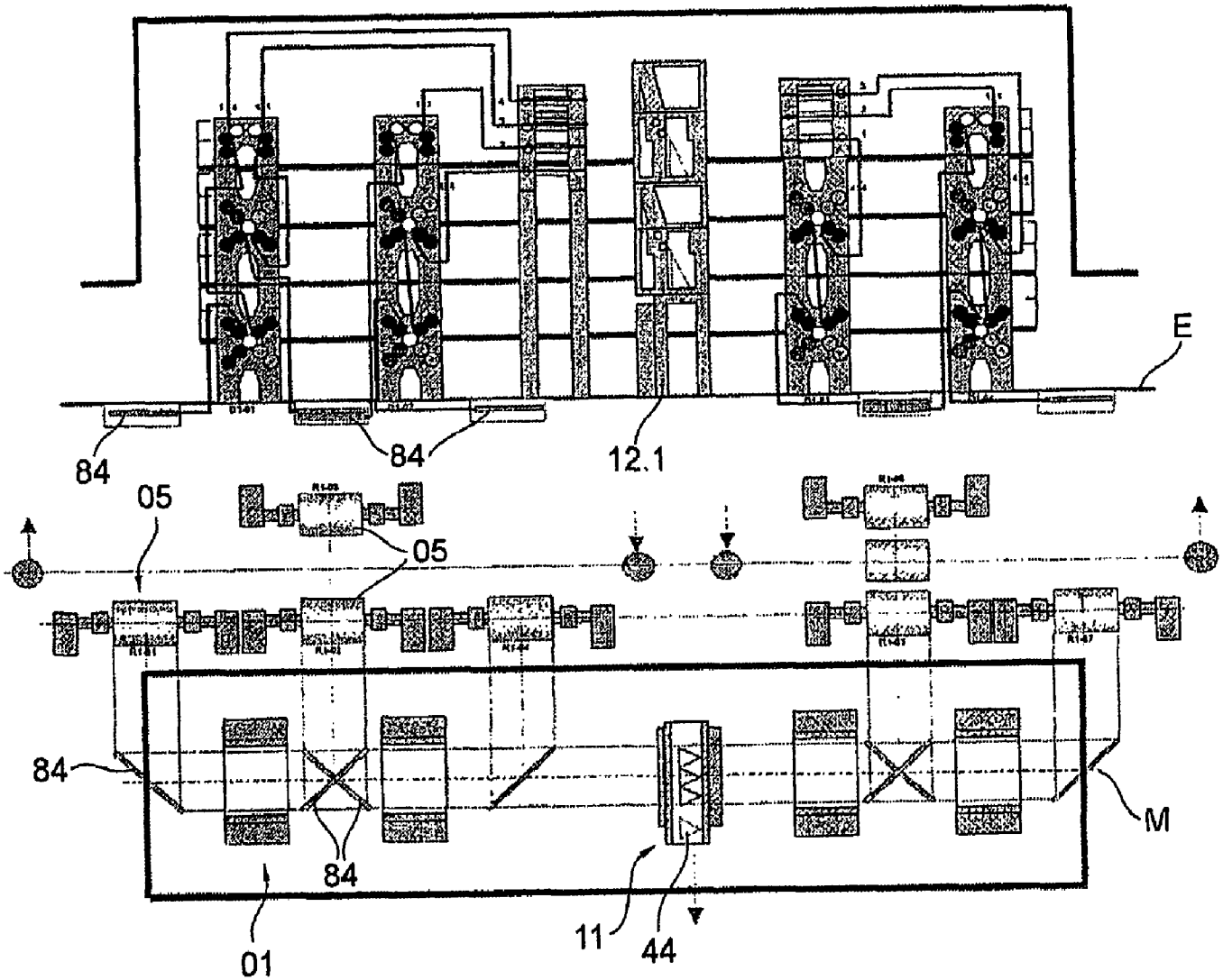

FIG. 34 shows a printing press, in particular in a tripe-width embodiment, for printing six side-by-side arranged newspaper pages. Printing towers 01, 01*a*, with stacked printing units, and in particular with satellite printing units, have been assigned to both sides of each folding structure 11, which is consisting of, for example, two levels with respectively three formers side-by-side. A printing press section, which is equipped substantially in the same way, has, for example, on both sides of the folding structure 11, two printing towers 01, 01*a*. In an advantageous further development, two further print locations, in, for example the form of a six-cylinder printing unit 83, or of two three-cylinder printing units 83, have been assigned to at least one of these printing towers 01, in addition to the eight print locations of the satellite printing units 02. These two additional print locations can possibly also advantageously be on a printing tower of a printing press, separate from the particular printing press in accordance with FIG. 34 and in combination with one or with several of the above-mentioned characteristics. It is then possible, in connection with a printing tower 01 which has been expanded in this manner, to imprint either two webs 03 each on one side in four colors and on the other side in one color, or to imprint a web 03 in four colors on both sides and to imprint a second web 03 in one color on both sides. In contrast to embodiments on one level, as seen in FIGS. 35, 36, the printing press is multi-story in the sense that the printing towers, or the lower printing units 02 and the roll changers 05 are not arranged on the same level of the installation. In this case, the printing towers are arranged on a level T above the level G which is supporting the roll changers 05. The printing towers are then arranged on a so-called "platform", in particular a platform which is made of concrete.

The printing press shown in FIG. 34 has three such printing press sections wherein, as marked by way of example by *, webs 03 from distant printing towers 01 of the adjacent printing tower section, but which are located upstream of the next folding structure 11, can be transferred. For example, five roll changers 05 are assigned to each one of these sections, which consists of four printing towers 01, 01*a* and of a folding structure 11. Depending on the requirements of the desired production, it is possible to provide turning towers with three, four or five turning devices 07 or turning decks. A folding apparatus 12, shown here at F1, F2, F3 is arranged downstream of each folding structure 11. A selection of advantageous product options and products is additionally listed in FIG. 34. The identification is explained by the production with a gray background in connection with the web guidance represented for line 3.

In the configuration in accordance with line 3, two products (2×), each of 84 lines (S.) from respectively 7 webs (B.) are formed on two folding apparatuses, here F1 and F3. This takes place here in a broadsheet arrangement, with standing newspaper pages in the circumferential direction of the forme cylinder 16 and in double production, during operations without collation. In this case, it is possible for two similar printing formes 19, 19', 19" to be respectively placed, one behind the other, on double-sized forme cylinders 16, for example, and in this way, to form double the output of products per unit of time per continuous web. Alternatively, two different products can be created respectively alternately on the continuous web and can be correspondingly removed respectively alternately in two product flows. For example, initially four webs, which are imprinted in 4/4 printing, are conducted from the right onto the first folding apparatus 12 from the left (F1). Two webs imprinted 1/4 and 4/1 in the printing tower on the left outside, and one web imprinted 4/4 in the adjoining printing tower are also conducted to the first folding apparatus. The product has 84 pages, 72 of which are imprinted in four colors, and the rest of which are imprinted in one color. The same applies here in regard to the product formed on the other folding apparatus. The remaining nine lines of the table should be read in the same way wherein, for example in line 6, a product of 72 pages (S.) and having 60 four-colored pages is formed on two folding apparatuses, F1 and F3, from respectively 6 webs (B.), and a 24-page product is created on one folding apparatus, identified here as F2.

In an advantageous embodiment, the offset printing groups 13 of at least one of the printing groups 02 of a printing tower 01, for example, all of the printing groups 02, 83 of a printing tower, and advantageously all of the printing groups 02, 83 of an entire printing press section, and in particular all printing groups 02, 83 of the printing press are configured in the above-described embodiment, either equipped, or structured so that they can be equipped, with printing formes 19" of a width of three pages and/or dressings 21 of a width of three pages.

The folding structures 11 have at least one former level, however two former levels are advantageously arranged on top of each other, with the three formers 41 to 43 located next to each other, in an arrangement seen, for example in FIGS. 4 to 16. One, or several of these folding structures can advantageously also have a lateral added former 44, such as shown in FIGS. 12 to 14, or possibly can have an additional former level.

FIG. 35 shows a printing press in a ground-level construction. Roll changers 05 and printing towers 01, 01*a* are substantially arranged on the same level E, such as, for example, on a ground level E. This can have advantages with respect to construction costs by requiring no basement, or by allowing a reduced height of a building 86, such as, for example, a shed 86, housing the printing towers 01.01*a*. It is then possible to structure the building 86 considerably lower in an area outside of the printing towers 01, 01*a* and/or the folding structure 11, which is only sketched in FIG. 35.

As can be seen in a view from above, in the lower portion of FIG. 35, an additional former 44 can be arranged laterally with respect to the group of the three formers. This can be the case for one of the two former levels, or for both of the former levels shown in solid lines, if for example these levels again have three side-by-side formers 41, 42, 43. This added former can have the same width as the other three formers or, as shown in FIG. 13, it can also have a greater width. It is then possible to move seven continuous product webs, for example so-called "books" over a total of seven formers, twice three plus an added former and, with a greater width of the added former, to selectively form a product of greater width on the added cylinder. However, in an embodiment without the laterally arranged added cylinder 44, the two former levels can also be embodied in the manner represented in FIG. 16 with one level of three formers, and with the other level of two wider formers. An embodiment can be optional in which two "normal" former levels with three side-by-side arranged formers, as shown in FIG. 32, are provided, and in addition two added formers 44 on a level above, as indicated in dashed lines here in the manner of the two upper formers 44 in FIG. 16, are arranged above.

One or several of the printing towers 01, such as the ones identified by 01*a* here, can have additional printing units 83.

In a preferred embodiment of a printing press in accordance with FIG. 36, the web is fed from the roll changer 05 from a direction of the long side of the press, or at a 90° angle with respect to the printing press center level M. The printing press is configured as a ground level structure, in which the roll changer 05 and the printing towers 01, 01*a* are substantially arranged on the same level. The roll changer or changers is, or are, located laterally next to the press. An axis of rotation of the rolls of material or paper substantially extends parallel with respect to the printing press center axis M. After being rolled off transversely with respect to the press, the web now runs at the level of the press alignment onto a deflection element 84, such as, for example, a guide element 84 provided in the manner of a turning bar 84, so that thereafter its movement direction lies in the printing press center level M. The guide element 84 has a length which, when projected on the incoming web, corresponds at least to the maximum width of the web. Advantageously, the guide element 84 is inclined by 45° with respect to the running direction of the incoming web and to the press center level M. In the instant case, the guide element 84 has a length which, when projected on the incoming web, corresponds at least to six side-by-side located newspaper pages. In the case of a 90° offset of the roll changer 05, the usable length of the turning bar 84 corresponds to at least 1.4 times of the maximum web width to be processed in the printing press, thus in this case, it corresponds to at least to 1.4 times the web of a width of six newspaper pages, or at least 8.5 newspaper page widths. It is also possible to provide two turning bars which cross each other between two printing towers 01, which then make possible deflection in the one direction, as well as in the other direction. In this case, the two crossing turning bars 84 can then either be selectively supplied with this web by one roll changer 05 or, as represented, can be simultaneously supplied by two roll changers 05, which are located in the same alignment.

In view of a dependable web guidance, it is possible to provide a draw-in device which adjusts the web traction possibly upstream of the turning bar 84, but which preferably adjusts the web tension between the turning bar 84 and its entry into the printing tower 01.

Considered by itself, but also in connection with one or several of the above mentioned advantageous characteristics, the lateral arrangement of the roll changers 05 can provide particular advantages.

While preferred embodiments of offset printing groups of a printing press for newspaper printing and a web-fed rotary printing press, in accordance with the present invention, have been set forth fully and completely hereinabove, it will be apparent to one of skill in the art that various changes in, for example, the type of web being printed, the specific drives for the printing units, and the like could be made without departing from the true spirit and scope of the present invention which is accordingly to be limited only by the appended claims.

What is claimed is:

1. An offset printing group of a printing press for newspaper printing comprising:

a forme cylinder, said forme cylinder having a length in an axial direction of said forme cylinder and being adapted to receive a plurality of printing formes carrying at least six standing newspaper pages, said forme cylinder axial length being divided at its center by an imaginary centerline of said printing press, which imaginary centerline extends perpendicularly to said forme cylinder axial direction, one half of said at least six standing newspaper pages on said plurality of printing formes being positioned on said forme cylinder on each side of said imaginary centerline;

a transfer cylinder cooperating with said forme cylinder to form said offset printing group, said transfer cylinder having a length in an axial direction of said transfer cylinder the same as said forme cylinder axial length and also of said plurality of printing formes carrying said at least six standing newspaper pages, said transfer cylinder having a shell surface and spaced transfer cylinder ends, said transfer cylinder axial length also being divided at a center of its axial length by said imaginary centerline; and at least first and second printing blankets arranged side-by-side in said axial direction of said transfer cylinder shell surface, at least one of said first and second printing blankets extending on said shell surface of said transfer cylinder, in said transfer cylinder axial length, from an outer edge at one of said transfer cylinder ends to an inner edge at said imaginary centerline and having a width, in said transfer cylinder axial direction, of at least three of said standing newspaper pages and wherein, in a first mode of operation, said forme cylinder has said printing formes having said print images of said at least six standing newspaper pages of a first format and with each said newspaper page being of a first page width in said forme cylinder axial direction, and in a second mode of operation, said forme cylinder has said printing formes having said print images of said at least six standing newspaper pages of a second format and with each said newspaper page being of a second page width in said forme cylinder axial direction, said second page widths of said newspaper pages being less than said first page widths of said newspaper pages said imaginary centerline being aligned with said inner edge of said at least one of said at least first and second printing blankets and defining a fold line for one of a partial web and a web printed with said ones of said print images positioned on said forme cylinder immediately adjacent to, and on either side of said imaginary centerline.

2. The offset printing group of claim 1 further wherein said plurality of printing formes are arranged side-by-side in an axial direction on said forme cylinder shell surface, at least one of said plurality of printing formes having a width in said axial direction of three standing newspaper pages.

3. The offset printing group of claim 1 wherein six printing formes are arranged side-by-side in said axial direction of a shell surface of said forme cylinder and wherein each of said printing formes has a width in said forme cylinder axial direction of one standing newspaper page.

4. The offset printing group of claim 1 wherein there are two of said printing blankets on said transfer cylinder, and further wherein each of said two printing blankets has said width of three standing newspaper pages.

5. The offset printing group of claim 2 wherein said printing forme having said width of three standing newspaper pages is provided with said print images of three newspaper pages side-by-side.

6. The offset printing group of claim 5 wherein said printing blanket of a width of three standing newspaper pages receives said print images from said printing formes having said print images of three newspaper pages side-by-side.

7. The offset printing group of claim 4 wherein said two printing blankets are arranged offset on said transfer cylinder in a circumferential direction.

8. The offset printing group of claim 4 further including two axially extending groove openings in said transfer cylinder and each offset from the other, in a circumferential direction, ends of said first and second printing blankets being fastened in said groove openings.

9. The offset printing group of claim 8 wherein each of said two groove openings extends over said width of said two printing blankets.

10. The offset printing group of claim 8 wherein each of said two groove openings extends over said width of one of said printing blankets.

11. The offset printing group of claim 1 further including a first continuous groove opening on said transfer cylinder and wherein ends of a first aligned pair of said printing blankets are received in said continuous groove opening.

12. The offset printing group of claim 11 further including a second continuous groove opening in said transfer cylinder and offset from said first continuous groove opening by 180° and further including a second aligned pair of said printing blankets arranged behind said first pair of aligned printing blankets on said forme cylinders with ends of all of said printing blankets being received in said first and second continuous groove openings.

13. The offset printing group of claim 1 wherein each of said printing blankets is a multi-layered printing blanket having at least one elastic layer on a dimensionally-stable support plate.

14. The offset printing group of claim 1 wherein said forme cylinder has a circumference of two printed pages arranged one behind the other in a standing newspaper format.

15. The offset printing group of claim 1 wherein said forme cylinder is adapted to receive first and second ones of said plurality of printing formes which are arranged one behind the other in a circumferential direction of said forme cylinder.

16. The offset printing group of claim 1 further including a continuous groove opening on said forme cylinder and wherein ends of two axially aligned ones of said plurality of printing formes arranged on said forme cylinder are received in said continuous groove.

17. The offset printing group of claim 15 further including first and second axially extending, continuous groove openings in said forme cylinder and offset with respect to each other by 180°, ends of said first and second ones of said plurality of printing formes being received in said two groove openings.

18. The offset printing group of claim 17 wherein each of said grooves has a slit width in a circumferential direction of not more than 5 mm.

19. The offset printing group of claim 2 wherein said printing forme having said width of three standing newspaper pages is exposed asymmetrically with said print images.

20. The offset printing group of claim 2 wherein three of said print images of a newspaper format are arranged equidistant on said printing forme of said width of three standing newspaper pages in a direct sequence from said printing press imaginary centerline, and further including a non-printing area on each edge of said forme cylinder adjacent each end of said forme cylinder.

21. The offset printing group of claim 20 wherein each of said non-printing edge areas has a length of from 50 mm to 100 mm.

22. The offset printing group of claim 2 wherein said printing forme having said width of three standing newspaper pages has a width between 950 mm and 1200 mm.

23. The offset printing group of claim 1 wherein each said printing blanket of said width of three standing newspaper pages has a width between 950 mm and 1200 mm.

* * * * *